US012622520B2

(12) United States Patent
Xiao

(10) Patent No.: US 12,622,520 B2
(45) Date of Patent: May 12, 2026

(54) MOUNTING ASSEMBLY AND APPARATUS

(71) Applicant: Jolly Innovation Technology Co., Ltd., Guangdong (CN)

(72) Inventor: Li Xiao, Shenzhen (CN)

(73) Assignee: Jolly Innovation Technology Co., Ltd., Guangzhou (CN)

( * ) Notice: Subject to any disclaimer, the term of this patent is extended or adjusted under 35 U.S.C. 154(b) by 0 days.

(21) Appl. No.: 18/975,047

(22) Filed: Dec. 10, 2024

(65) Prior Publication Data

US 2025/0359672 A1 Nov. 27, 2025

(30) Foreign Application Priority Data

May 21, 2024 (CN) ..... 202421118288.8
Oct. 11, 2024 (CN) ..... 202422464827.X

(51) Int. Cl.
*A47B 97/00* (2006.01)

(52) U.S. Cl.
CPC ..... *A47B 97/001* (2013.01)

(58) Field of Classification Search
CPC .... F16M 13/02; F16M 13/022; F16M 11/041; F16M 11/10; F16M 11/048; F16M 11/045; F16M 11/2085; A47B 97/001; Y10S 248/917; Y10S 248/92; Y10S 248/919; Y10S 248/924
See application file for complete search history.

(56) References Cited

U.S. PATENT DOCUMENTS 7,300,029 B2 * 11/2007 Petrick ..... F16M 13/02 248/921
7,441,739 B2 * 10/2008 Huang ..... F16M 13/02 248/917
7,712,717 B2 * 5/2010 Burns ..... F16M 11/10 248/291.1
7,823,847 B2 * 11/2010 Bremmon ..... F16M 13/02 248/920
7,878,473 B1 * 2/2011 Oh ..... F16M 11/046 248/490
7,963,489 B2 * 6/2011 O'Keene ..... F16M 11/10 248/924
8,025,264 B2 * 9/2011 Cheng ..... H05K 5/0204 248/222.13
8,203,854 B2 * 6/2012 Tsai ..... F16M 13/02 248/327

(Continued)

*Primary Examiner* — Patrick D Hawn
(74) *Attorney, Agent, or Firm* — ScienBiziP, P.C.

(57) ABSTRACT

The present disclosure provides a mounting assembly configured for attaching at least one apparatus to a wall, the mounting assembly comprising: many mounting brackets configured to be connected to the at least one apparatus; a guide bar coupled with the mounting bracket, the guide bar extending in an extending direction; and, many bases coupled to the guide bar, the base comprising a first base, and the first base comprising: a main plate configured to be attached to the wall; a first connecting plate configured for engaging with the guide bar; and a second connecting plate disposed opposite the first connecting plate, wherein the first connecting plate and the second connecting plate are attached to the main plate, and cooperates to define a receiving space, the base receives the guide bar into the receiving space, the first and the second connecting plates cooperatively limit the guide bar in the receiving space.

20 Claims, 19 Drawing Sheets

(56) References Cited

U.S. PATENT DOCUMENTS 8,262,044 B2 * 9/2012 Luijben ..... F16M 11/10 248/920
8,267,366 B2 * 9/2012 Cheng ..... F16M 11/046 248/295.11
8,322,673 B2 * 12/2012 Sculler ..... F16M 13/02 248/917
8,456,808 B2 * 6/2013 Grey ..... F16M 11/10 361/679.01
8,482,907 B2 * 7/2013 Take ..... H05K 5/0204 361/679.01
8,550,415 B2 * 10/2013 Sculler ..... H05K 5/0204 248/495
8,556,220 B1 * 10/2013 Chen ..... F16M 13/02 248/222.13
8,690,111 B2 * 4/2014 Huang ..... F16M 11/10 248/371
8,864,092 B2 * 10/2014 Newville ..... F16M 13/02 361/679.01
9,644,787 B2 * 5/2017 McArdle ..... F16M 13/02
10,064,489 B2 * 9/2018 Sculler ..... F16M 13/02
10,104,963 B2 * 10/2018 Brandt ..... A47B 81/065
10,746,350 B2 * 8/2020 Pei ..... F16M 11/041
11,105,458 B2 * 8/2021 Runger ..... F16M 11/041
11,473,722 B2 * 10/2022 Amidei ..... F16M 11/08
11,779,115 B2 * 10/2023 Pei ..... F16M 11/08 248/277.1
11,867,346 B2 * 1/2024 Chung ..... F16M 13/02
11,882,379 B2 * 1/2024 Bremmon ..... A47B 97/001
11,965,542 B2 * 4/2024 Van Kuijk ..... F16M 13/02
12,085,223 B1 * 9/2024 Ozkan ..... A47B 96/063
2005/0087661 A1 * 4/2005 Rabenius ..... F16M 11/2085 248/309.1
2006/0065800 A1 * 3/2006 Bremmon ..... F16M 13/02 248/274.1
2007/0023375 A1 * 2/2007 Fedewa ..... F16M 11/046 211/102
2007/0023593 A1 * 2/2007 Fedewa ..... F16M 13/02 248/201
2008/0156949 A1 * 7/2008 Sculler ..... F16M 11/10 248/220.21
2008/0237424 A1 * 10/2008 Clary ..... F16M 11/046 248/283.1
2023/0184375 A1 * 6/2023 Kolz ..... F16M 11/2014 312/7.2
2024/0209979 A1 * 6/2024 Newville ..... F16M 11/2014
2025/0020271 A1 * 1/2025 Xu ..... F16M 13/02
2025/0172232 A1 * 5/2025 Xu ..... F16M 11/2085

* cited by examiner

MOUNTING ASSEMBLY AND APPARATUS

RELATED APPLICATIONS

This application claims the benefit of priority to Chinese Patent Application Number 202422464827.X filed on Oct. 11, 2024, and Chinese Patent Application Number 202421118288.8 filed on May 21, 2024, both in the China National Intellectual Property Administration. The entire contents of the above-identified application are hereby incorporated by reference.

TECHNICAL FIELD

The present invention is related to a mounting assembly for mounting a device to a wall, in particular, related to a mounting assembly for mounting one or more monitors on the wall.

BACKGROUND

A plurality of televisions or computer monitors are usually arranged on a wall in a monitoring room of some places, such as restaurants and shopping malls, to provide real-time images of different regions. In recent years, it is widely used to splice several display screens for forming a large-screen LCD display. Thereby, a mounting assembly that can arrange multiple displays together and fix them on the wall is urgently needed.

BRIEF DESCRIPTION OF DRAWINGS

In order to illustrate the technical solution in embodiments of the present invention more clearly, the following briefly introduces accompanying drawings used in the description of the embodiments. Obviously, the accompanying drawings in the following description are only some embodiments of the present invention. Those of ordinary skill in the art can obtain other accompanying drawings from these accompanying drawings without any creative efforts.

DETAILED DESCRIPTION

Reference will now be made in detail to representative embodiments illustrated in the accompanying drawings. It should be understood that the following descriptions are not intended to limit the embodiments to one preferred implementation. To the contrary, the described embodiments are intended to cover alternatives, modifications, and equivalents as can be included within the spirit and scope of the disclosure and as defined by the appended claims.

First Embodiment

Figure 1:
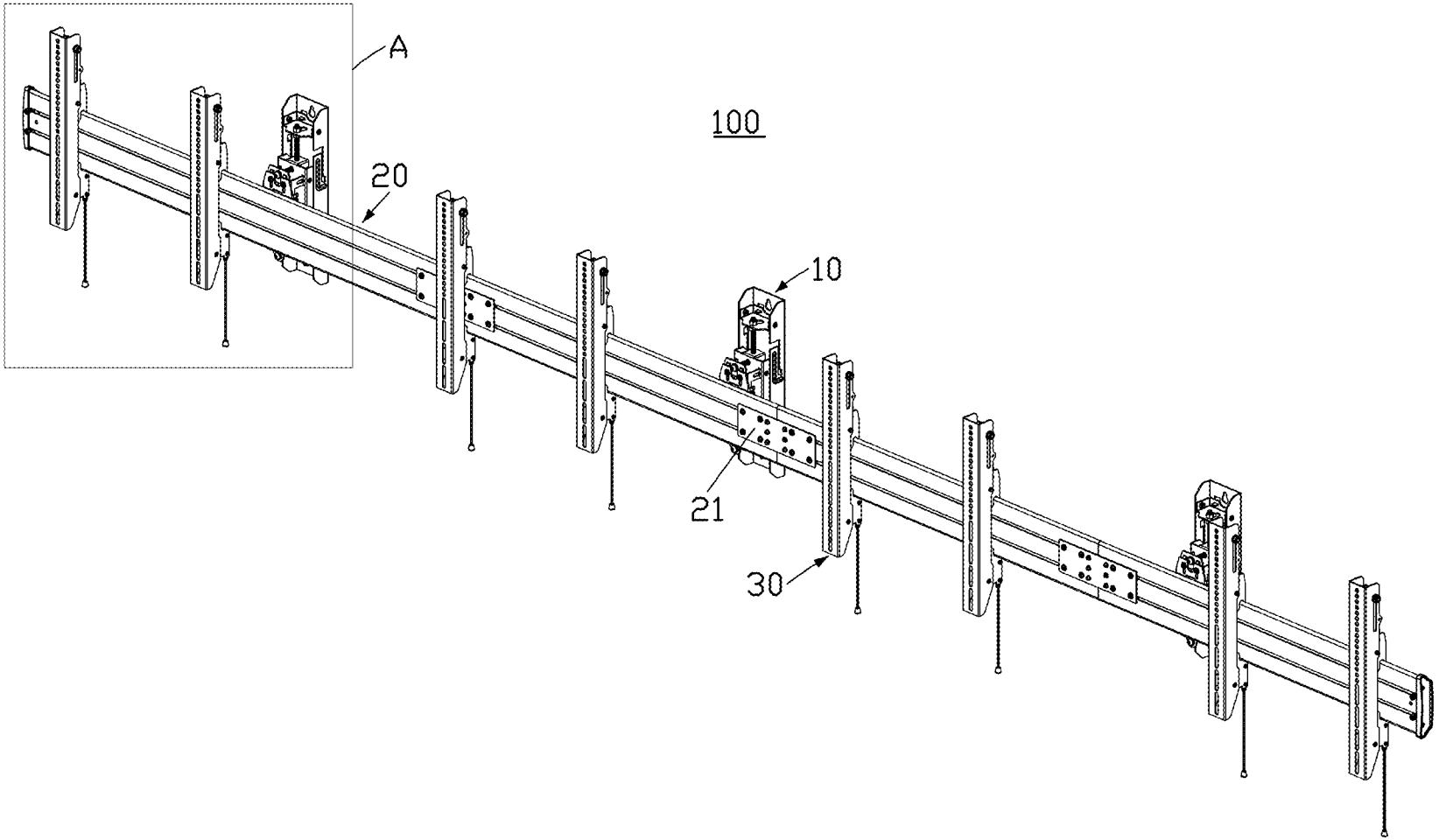
FIG. 1 is a perspective view of a mounting assembly according to a first embodiment of the present disclosure.

As shown in FIG. 1, a first embodiment of the present disclosure provides a mounting assembly 100, which is configured for mounting apparatus on a wall 200. In this embodiment, the apparatus comprises one or more monitors.

Refer to FIG. 1, the mounting assembly 100 comprises a plurality of bases 10, a guide bar 20 and at least one mounting bracket 30. The bases 10 are fastened on a surface of the wall 200 with each two adjacent bases being spaced apart. The guide bar 20 is detachably installed on one side of each base 10 and configured for being held by the bases. The mounting bracket 30 is detachably attached on the guide bar 20 and configured for connecting with a monitor. The monitor is installed on a side of the mounting bracket 30, the side is away from the guide bar 20.

Figure 2:
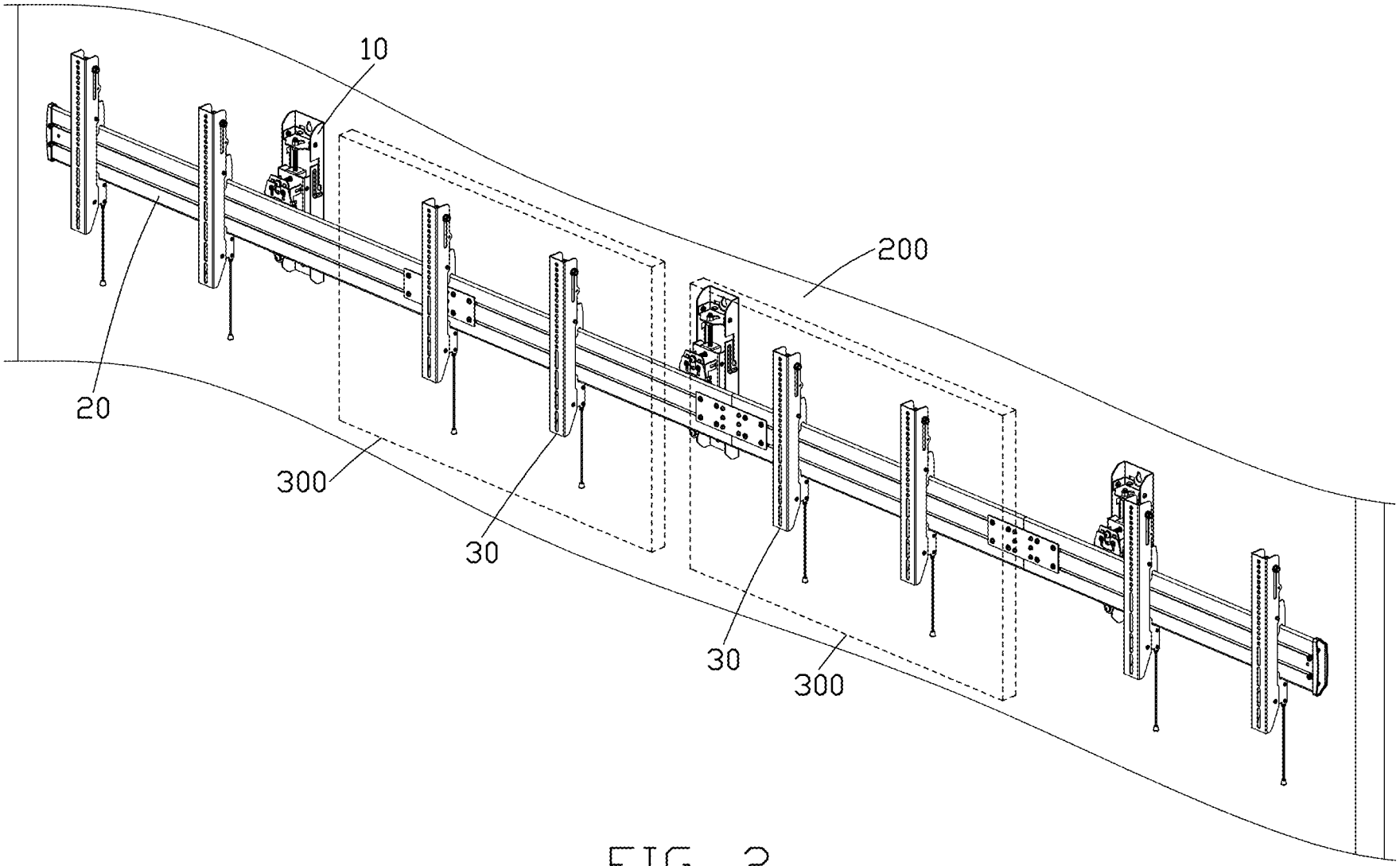
FIG. 2 is a perspective view of the mounting assembly shown in FIG. 1 showing from another viewing direction.

The mounting assembly 100 is suitable for mounting a muti-screen display, such as a dual-screen display, a triple-screen display, a quad-screen display, or a penta-screen display. This embodiment takes a quad-screen display as an example for illustration. Referring also to FIG. 2, there are four pair of mounting brackets 30 installed at a front side of the guide bar 20. The bases 10 are connected to a rear side of the guide bar 20. The four pairs of mounting brackets 30 are arranged spaced from each other, wherein each pair of mounting brackets 30 is configured for connecting with a screen 300 of the quad-screen display. The bases 10 are spaced from each other and aligned along an extending direction of the guide bar 20. The guide bar 20 includes one or more sub-bars which extends along the extending direction. The sub-bar is made of aluminum materials, and any two adjacent sub-bars are connected to each other through a first connecting member 21 at a rear side and a second connecting member 21 at a front side.

Figure 3:
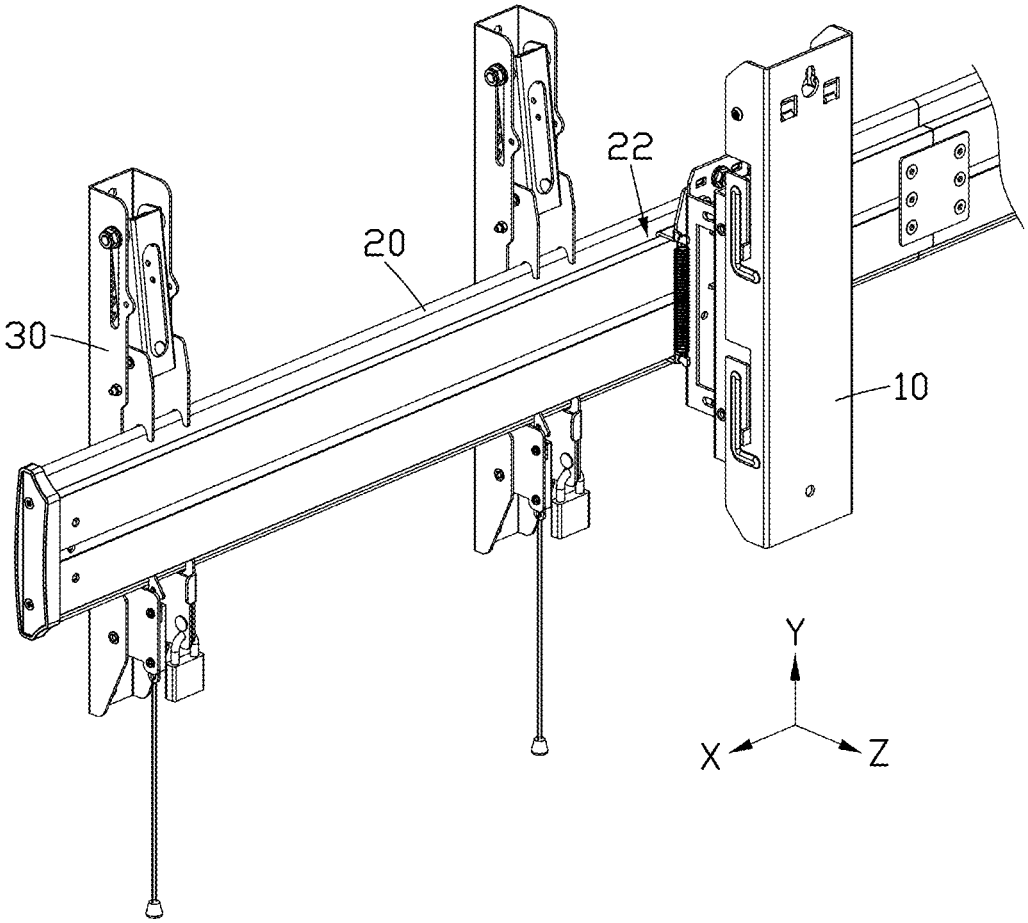
FIG. 3 is an enlarged view of the mounting assembly shown in FIG. 1 with a structure of a portion A as indicated in FIG. 1.

Refer to FIG. 3, the guide bar 20 includes a front track facing the mounting brackets 30 and a rear track facing the bases 10. The front track is parallel to the rear track. The mounting brackets 30 are mounted on the front track and slidable along the front track. The bases 10 are attached to the rear track and slidable along the rear track. The length of the front track in a first direction, such as an up-and-down direction, is larger than that of the rear track, so that a cross-section of the guide bar 20 in the up-and-down direction may be a trapezoidal structure. A latching groove 22 is defined in each of a top end and a bottom end of a rear side of the guide bar 20 for receiving a portion of the base 10 therein.

The bases 10 are fixedly and vertically attached to the surface of the wall 200. The guide bar 20 is placed on the bases 10 along a left-and-right direction and movable in the up-and-down direction and a second direction perpendicular to the up-and-down direction. The second direction may be a front-and-rear direction (direction Z). The mounting bracket 30 is slidable along the guide bar 20, thereby a location of the screen 300 attached to the guide bar 20 through the mounting brackets 30 being changeable at the up-and-down direction (direction Y), the front-and-rear direction and a third direction perpendicular to the up-and-down direction and the front-and-rear direction. The third direction may be a left-and-right direction (direction X).

Figure 4:
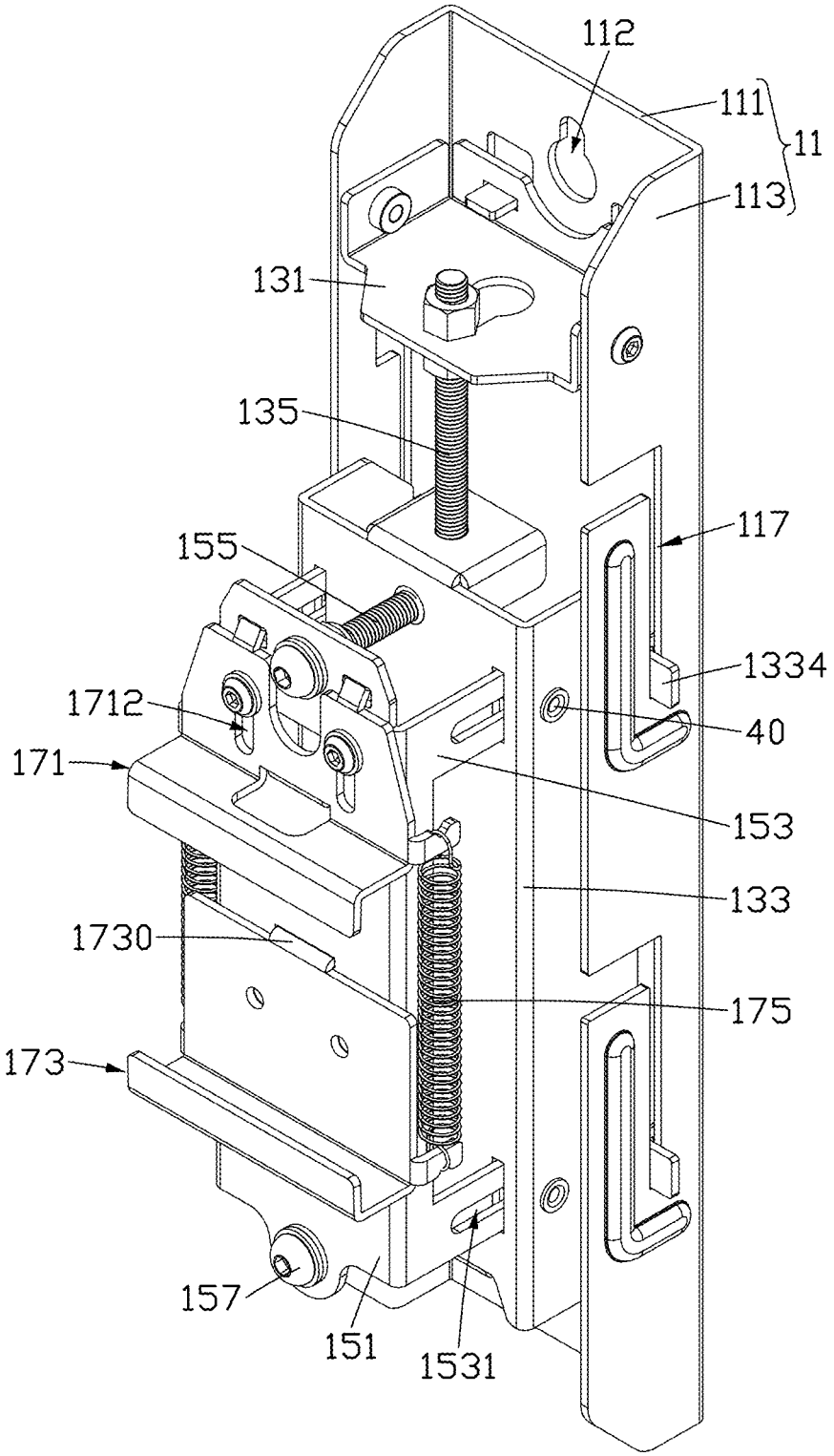
FIG. 4 is a perspective view of a base of the mounting assembly shown in FIG. 2.
Figure 5:
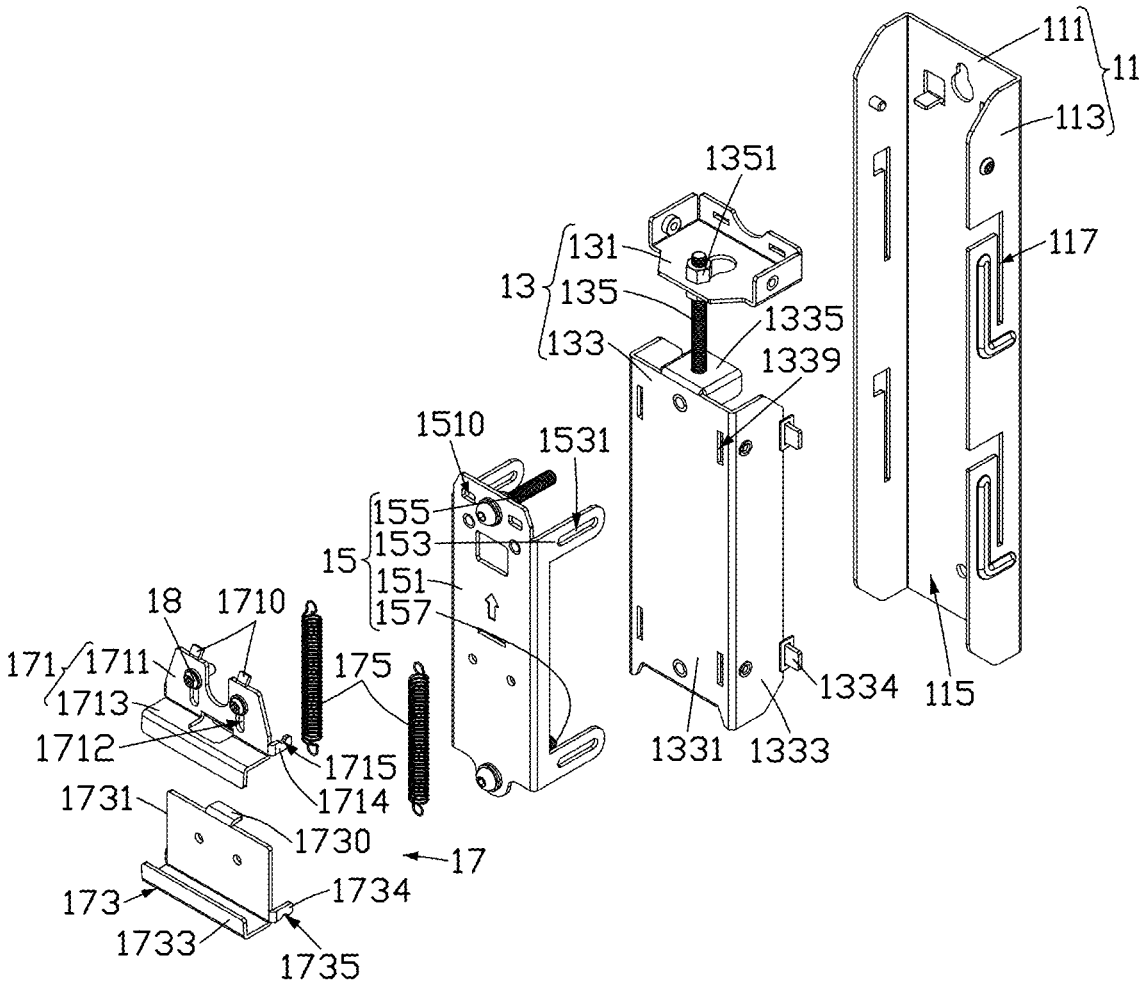
FIG. 5 is an exploded view of the base of the mounting assembly shown in FIG. 4.

Refer to FIG. 4 to FIG. 5, specifically, each base 10 comprises a main plate 11, a first adjustment portion 13, a second adjustment portion 15, and a connecting portion 17. A rear side of the main plate 11 is fixedly attached to the wall, a rear side of the first adjustment portion 13 is movably installed to a front side of the main plate 11, and is movable relative to the main plate 11 in the up-and-down direction. A rear side of the second adjustment portion 15 is movably installed to a front side of the first adjustment portion 13, and is movable relative to the first adjustment portion 13 in the front-and-rear direction to adjust a distance between the screen 300 and the wall 200. The connecting portion 17 is installed to a front side of the second adjustment portion 15. The connecting portion 17 is used to engage with the second track of the guide bar 20.

The main plate 11 may be an elongated shape and extend along the up-and-down direction. The main plate 11 comprises a bottom plate 111 and two side plates 113. Each side plate 113 is vertically connected to opposite long sides of the bottom plate 111. The bottom plate 111 and the two side plates 113 are cooperated to define a first-space 115 for receiving the first adjustment portion 13. Two fixing holes 112 are defined in the bottom plate 111 and configured to fix the base 10 to the surface of the wall. The two fixing holes 112 comprise a first fixing hole 112*a* and a second fixing hole 112*b* which are respectively arranged at a top and a bottom of the bottom plate 111. The first fixing hole 112*a* may be gourd-shaped, the second fixing hole 112*b* may be round-shaped or strip-shaped. The base 10 is stably attached to the wall through cooperations of the first fixing hole 112*a* and the second fixing hole 112*b* and fastening components. A sliding groove 117 is defined in each side plate 113.

The first adjustment portion 13 is movably installed between the two side plates 113 and partly received in the first-space 115. The first adjustment portion 13 comprises a support plate 131, an adjusting plate 133, and a first screw 135. The support plate 131 is accommodated in an upper portion of the first-space 115 and directly fastened on the bottom plate 111. The first screw 135 is attached to the support plate 131 and extends along the up-and-down direction. The first screw 135 engages with the support plate 131 for being moved relative to the support plate 131 in the up-and-down direction. The adjusting plate 133 is fixedly connected to the first screw 135 and movable together with the first screw 135. The adjusting plate 133 comprises a front plate 1331 and two side plates 1333, wherein the side plates 1333 are perpendicularly connected to opposite long sides of the front plate 1331. The two side plates 1333 are located between the two side plates 113 of the main plate 11. At least one sliding pin 1334 protrudes laterally from an out surface of each side plate 1333, and is configured for slidably inserting into a corresponding sliding groove 117 of the side plate 113. The two side plates 1333 of the adjustment plate 133 are received in the first-space 115. Four openings 1339 are defined in four corners of the front plate 1331. A fixing tab 1335 is rearward extended from an upper edge of the adjustment plate 133, and the first screw 135 is penetrated through the fixing tab 1335 and engages with the fixing tab 1335.

A first nut 1351 is configured to cooperate with the first screw 135 for hanging the adjusting plate 133 at a desired position. When it is needed to change a height of the adjusting plate 133, loosen the first nut 1351, pull the first screw 135 to move up or down until the adjusting plate 133 reaching the desired position, then tight the first nut 1351.

The second adjustment portion 15 is movably installed in the first adjustment portion 13. The second adjustment portion 15 is movable forward or backward along the front-and-rear direction to adjust the distance between the screen and the wall. The second adjustment portion 15 comprises a first wall 151, a plurality of guide tabs 153, a second screw 155, and a third screw 157. The first wall 151 is opposite the front plate 1331. Each guide tab 153 is protruded rearwardly from a corner of the first wall 151 then inserted into the corresponding opening 1339. A sliding slot 1531 is defined in each guide tab 153. The sliding slot 1531 extends along the front-and-rear direction. A connecting piece 40 inserts into the sliding slot 1531 after passing through the side plate 1333 and is slidable in the sliding slot 1531, thereby the first wall 151 is movable toward or away from the first adjustment plate 133.

Figure 7A:
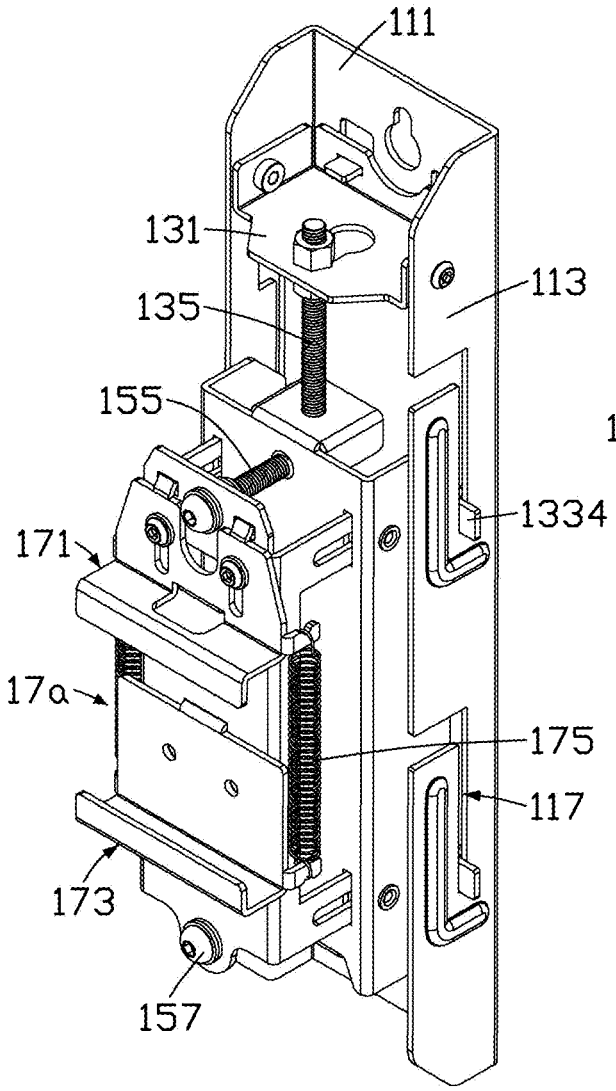
FIG. 7A illustrates a first state of the base of the mounting assembly shown in FIG. 5 during adjusting a connecting position.
Figure 7B:
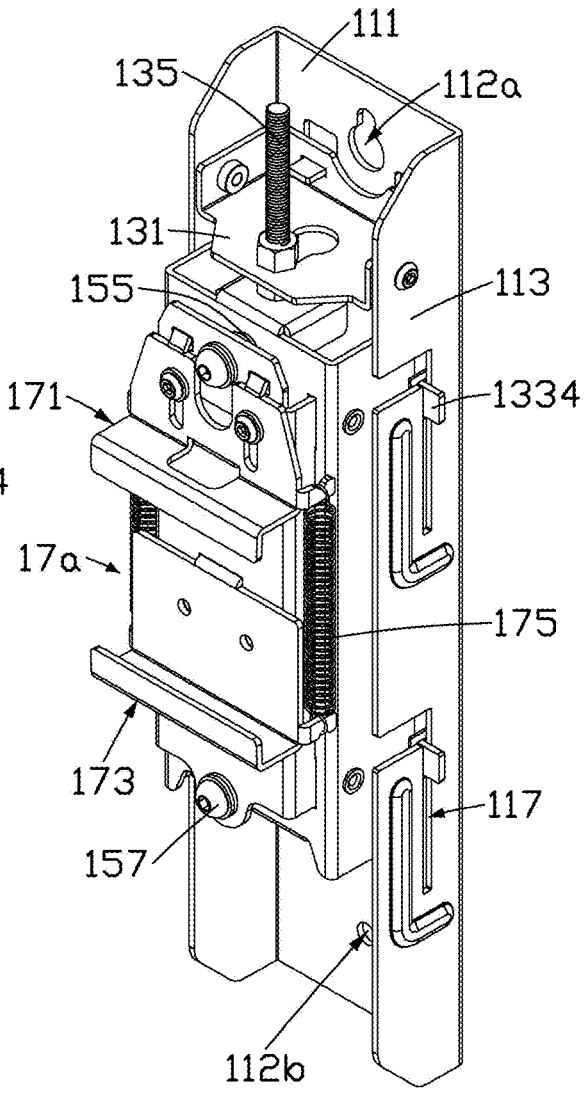
FIG. 7B illustrates a second state of the base of the mounting assembly shown in FIG. 5 during adjusting the connecting position.
Figure 8A:
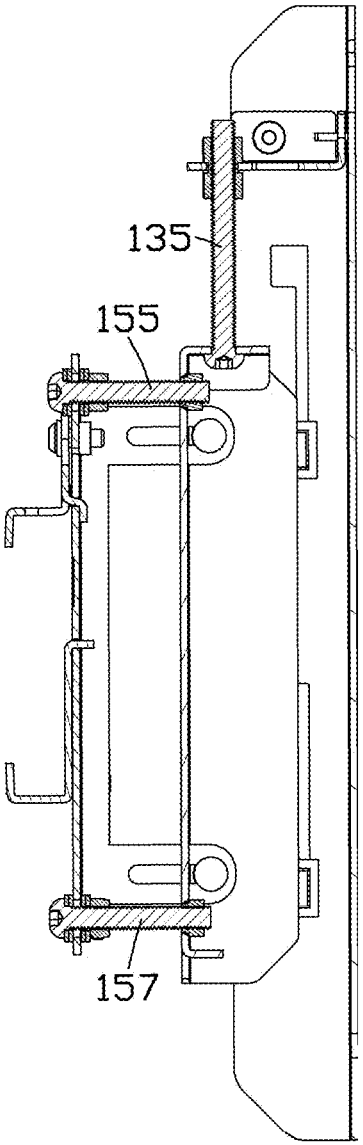
FIG. 8A is a cross-sectional view of the base of the mounting assembly shown in FIG. 7A.
Figure 8B:
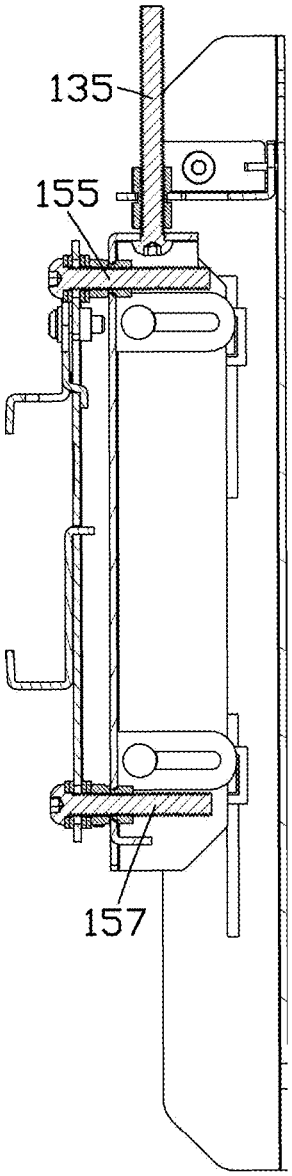
FIG. 8B is a cross-sectional view of the base of the mounting assembly shown in FIG. 7B.

The distance from the screen to the wall and the height from the ground can be adjusted via the first adjustment portion 13 and the second adjustment portion 15 respectively. Refer to FIG. 7A, the base 10 is in a first state at which the second adjustment portion 15 is located at a lowest and foremost position. The FIG. 8A depicts an exploded view of the base 10 at the first state. Conversely, refer also to FIG. 7B, the base 10 is in a second state at which the second adjustment portion 15 is located a highest and rearmost position, and the FIG. 8B depicts an exploded view of the base 10 at the second state.

Figure 6:
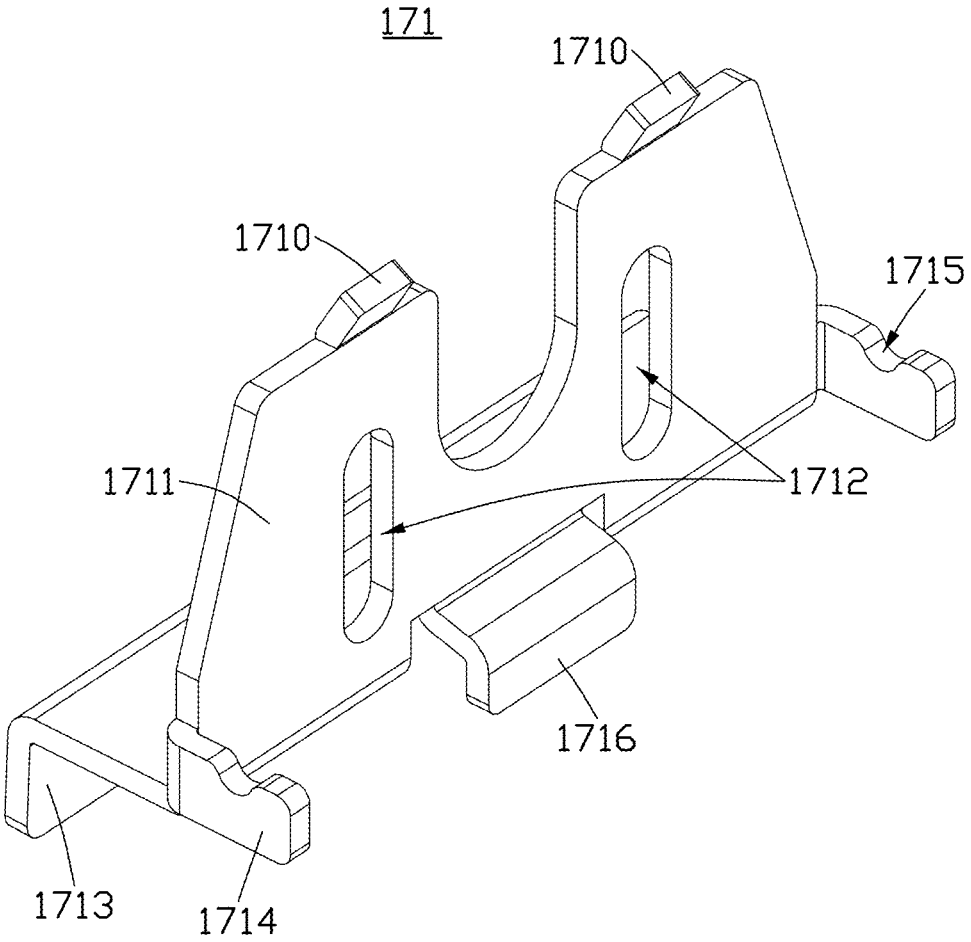
FIG. 6 is a perspective view of a first connecting plate of the mounting assembly shown in FIG. 5.

Refer to FIG. 4, FIG. 5 and FIG. 6, the connecting portion 17 is mounted on a front side of the first wall 151. The connecting portion 17 comprises a first connecting plate 171, a second connecting plate 173 and two springs 175. The first connecting plate 171 is disposed above the second connecting plate 173 and spaced away the second connecting plate 173, the first connecting plate 171 cooperates with the second connecting plate 173 to define a receiving space 17*a*, and the first and the second connecting plates 171,173 cooperatively limit the portion of the guide bar 20 in the receiving space 17*a*. Each spring 175 has two opposite ends, one of the two opposite ends is connected to the first connecting plate 171 and the other is connected to the second connecting plate 173, so as to provide elastic forces onto the first and second connecting plates 171 and 173.

As shown in FIG. 6, the first connecting plate 171 comprises a first plate 1711 attached to the first wall 151 and a blocking portion 1713 perpendicularly interconnected with a bottom of the first plate 1711. Two guide slots 1712 spaced apart with each other are defined in the first plate 1711. Each guide slot 1712 extends along the up-and-down direction. Two fasteners 18 pass through the two guide slots 1712 and then screw into the first wall 151, so that the first connecting plate 171 is stably installed on the front of the first wall 151. The fasteners 18 is movable relative to the guide slots 1712 along the up-and-down direction, so that the blocking portion 1713 moves together with the first plate 1711 along the up-and-down direction.

Two locking tabs 1710 extend upwardly and rearward from a top of the first plate 1711. The two locking tabs 1710 engage into two through-holes 1510 in the first wall 151 to fix the first plate 1711 to the first wall 151, thereby, the first connecting plate 171 and the first wall 151 are fixed together through the locking tabs 1710 or the fasteners 18 which prevents the separation of the first connecting plate 171. Two first protrusions 1714 are protruded and extended from both sides of the first connecting plate 171. A first notch 1715 is concaved at a top of each first protrusion 1714, and configured for connecting to a top end of the spring 175. A bent tab 1716 is extended rearward from a lower edge of the first connecting plate 1711 and then bents downwardly, a first hole 1716*a* is defined in the bent tab 1716.

As shown in FIG. 5, the second connecting plate 173 comprises a second plate 1731 and a second blocking portion 1733 perpendicularly interconnected with a bottom of the second plate 1731. A receiving groove (not shown) is defined by the second plate 1731 and the second blocking portion 1733 for receiving a bottom portion of the guide bar 20. A locking piece 1730 is formed on a top of the second plate 1731. The locking piece 1730 passes through a hole of the first wall 151 and then fixed to the first wall 151. The bottom of the second plate 1731 is welded to the first wall 151. Two second protrusions 1734 are protruded and extended rearward from both sides of the second plate 1731. A second notch 1735 is concaved in a bottom of each second protrusion 1734 for connecting to a lower end of the spring 175.

Figure 9:
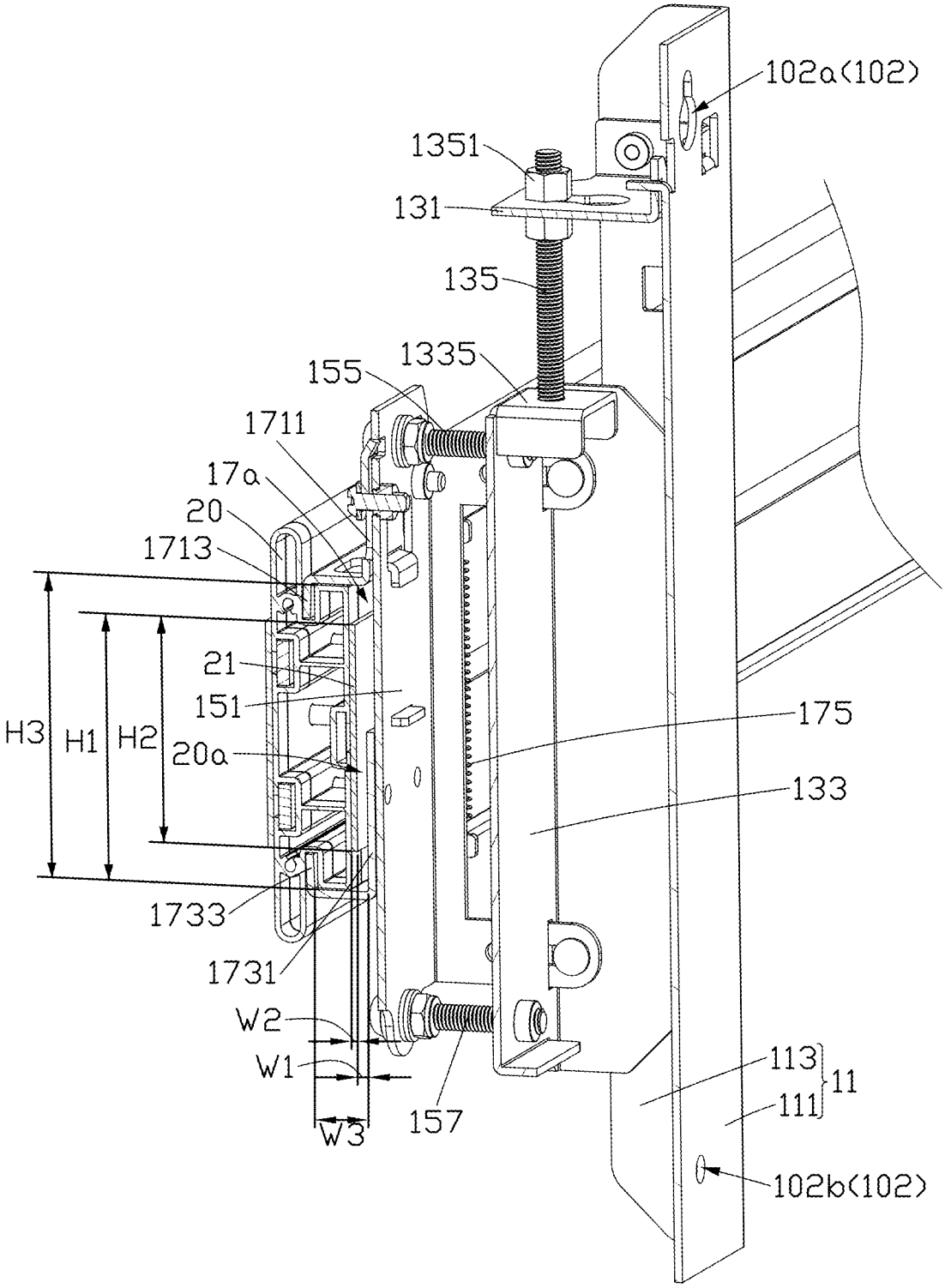
FIG. 9 is a cross-sectional view of a main plate attached to a guide bar and corresponded to a connecting member of the mounting assembly shown in FIG. 1.

As shown in FIG. 9, When the second connecting plate 173 is fixed to the first wall 151 and the first connecting plate 171 is attached to the first wall 151, the second plate 1731 is co-plane with the first plate 1711. A first channel 20*a* is defined by rear portions of the first connecting plate 171 and rear portions of the second connecting plate 173, the first channel 20*a* is located behind the receiving space 17*a* and air communicating with the receiving space 17*a*. A width of the first channel 20*a* (W1) is larger than a width of the first connecting member 21 (W2) and is smaller a width of the receiving space 17*a* (W3), a height of the first channel 20*a* (H1) is larger than a height of the first connecting member 21 (H2) and is smaller than a height of the receiving space 17*a* (H3). When the guide bar 20 slides along the base 10, the first connecting member 21 is extendable through the first channel.

The base 10 is further received the guide bar 20 into the receiving space 17*a* by selecting from one of a first assembly way and a second assembly way, the guide bar 20 is inserted into the receiving space 17*a* along the extending direction in the first assembly way, the guide bar 20 is inserted into the receiving space 17*a* along a second direction in the second way, the second direction intersects with each of the extending direction and the first direction.

When assembling the base 10, firstly, insert the four guide piece tabs 153 into the four openings 1339 of the adjusting plate 133 respectively, and then connect the four guide tabs 153 to the side plates 1333 of the adjusting plate 133 through the connecting piece 40, allowing the connecting piece 40 to slide in the sliding slots 1531 of each guide tab 153. Secondly, attach the first wall 151 to the adjusting plate 133 through the second screw 155, and the third screw 157. Afterward, push the four sliding pins 1334 into the sliding grooves 117 along the edge of the main plate 11. Finally, place the first nut 1351 on the support plate 131, screw the first screw 135 into the first nut 1351, thereby fixing the support plate 131 to the upper end of the main plate 11.

Figure 10A:
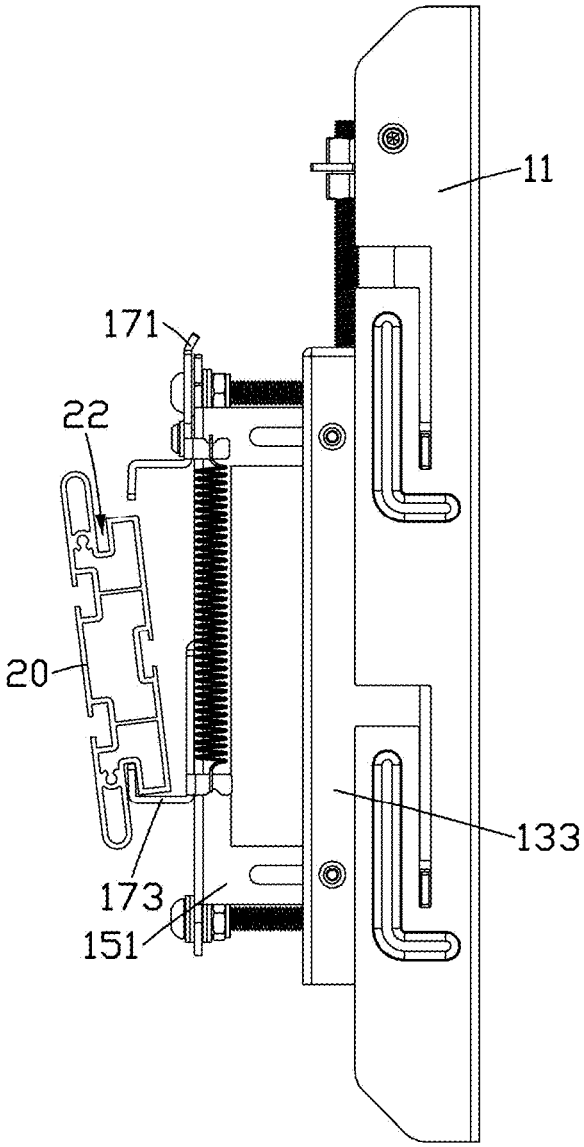
FIG. 10A illustrates a first assembled state of the mounting assembly shown in FIG. 3 with the guide bar being connected to the base.
Figure 10B:
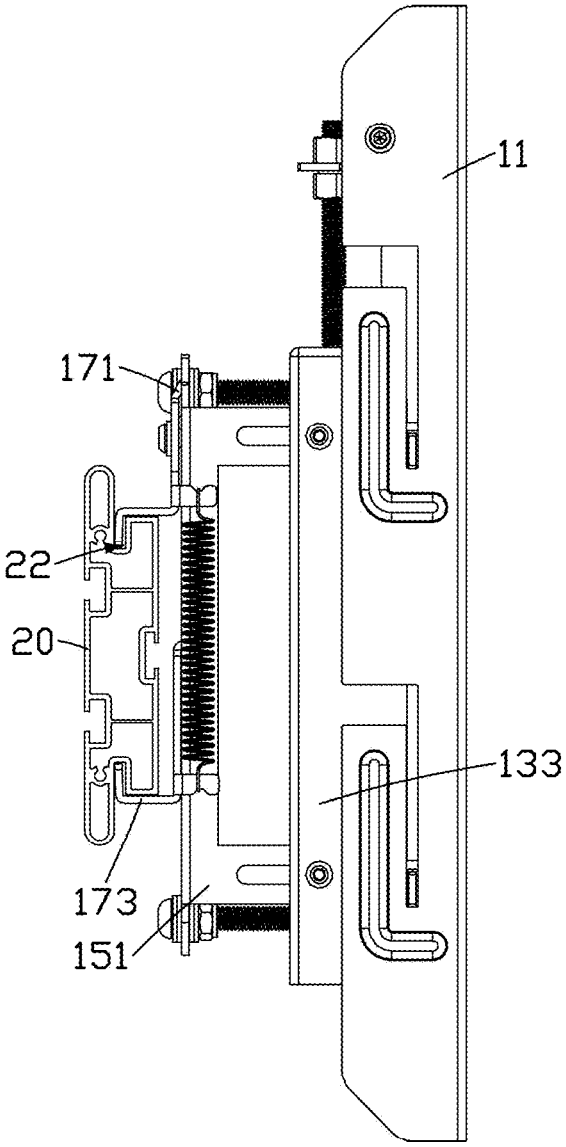
FIG. 10B illustrates a second assembled state of the mounting assembly shown in FIG. 3 with the guide bar being connected to the base.

Two grooves 22, comprising a first groove 22*a* and a second groove 22*b*, are defined in the upper and the lower edge of the rear side of the guide bar 20 respectively. As shown in FIG. 10A, when attaching the guide bar 20 to the front side of the connecting portion 17, the two locking tabs 1710 is separated from the two through-holes 1510, and the two fasteners 18 is loosen, and then the guide bar 20 is inclinedly held by hand, the second groove 22*b* receives the second blocking portion 1733 of the second connecting plate 173. Then, as shown in FIG. 10B, the upper end of the guide bar 20 abuts against the first connecting plate 171, push the guide bar 20 toward the base 10, so that the first connection plate 171 is pushed to move upward, the blocking portion 1713 is thus received in the first groove 22*a*. The first connecting plate 171 is pulled by the elastic force of the springs 175, so that the first connecting plate 171 is move back to its original position. Next, the fasteners 18 are tightened again to connect the base 10 to the guide bar 20, and the two locking tabs 1710 engage into the two through-holes 1510. Finally, the base 10 slides along the guide bar for being positioned at a designated position on the guide bar 20 with the first connecting member 21 passing through the channel of the base 10.

In some other embodiments, the base 10 may also be laterally inserted from a left side or a right side of the guide bar 20, such that the bottom of the first connecting plate 171 is caught in the first groove 22*a* and the top of the second connecting plate 173 is caught in the second groove 22*b*, and then the base 10 is slide on the guide bar 20 to the designated position. Since the width of the first channel 20*a* is larger than that of the first connecting member 21, such that the base 10 can smoothly pass through the first connecting member 21 and slide from one side of the guide bar 20 to the other side of the guide bar 20 or to the designated position.

Figure 11:
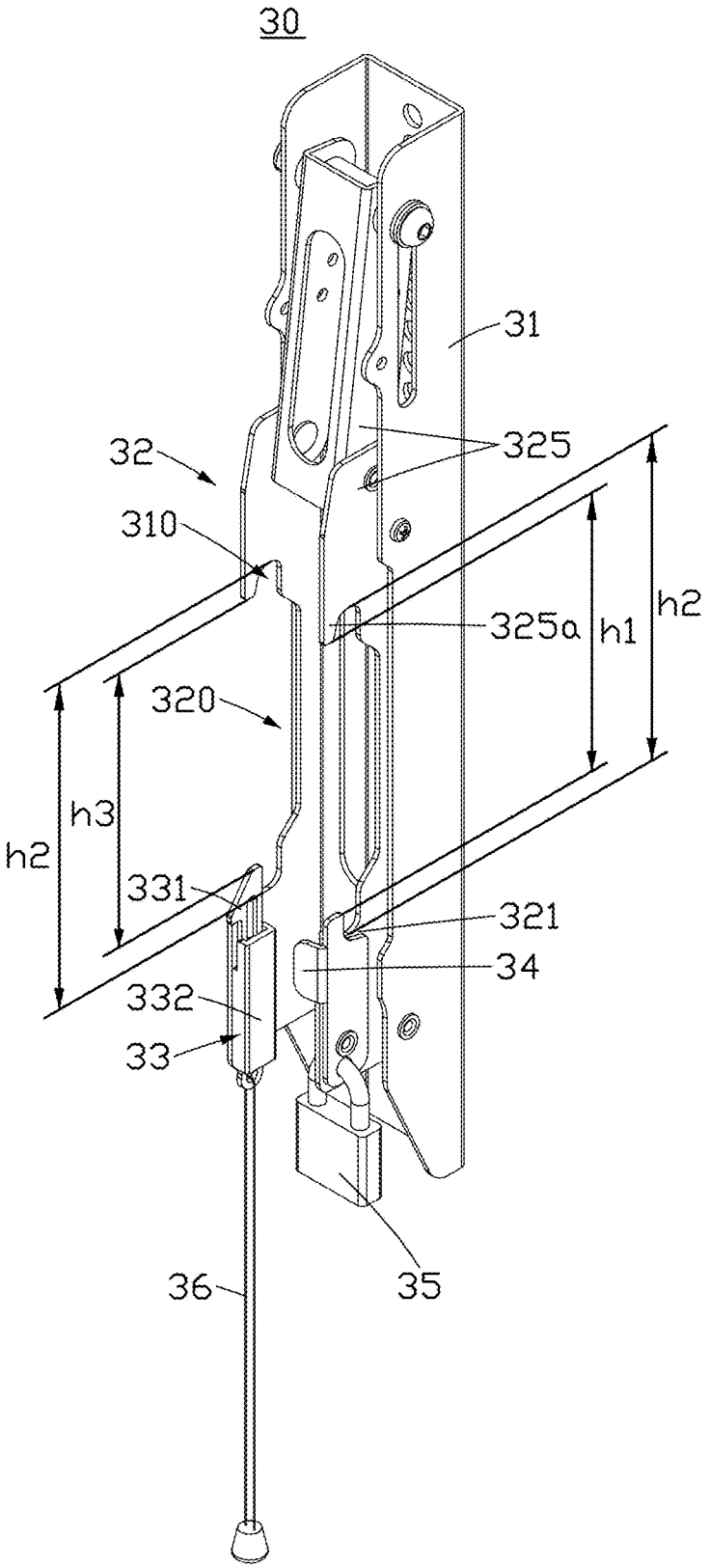
FIG. 11 is a perspective view of a mounting bracket of the mounting assembly shown in FIG. 3, showing from another viewing direction.

Refer to FIG. 11, each mounting bracket 30 includes a seat 31, a link portion 32, a blocking member 33, an anti-theft member 34 and a ring latch 35. The link portion 32 is fixed to an inner side of the seat 31, the blocking member 33 is movably installed with one side of the link portion 32, and the anti-theft member 34 is attached to another side of the link portion 32. The ring latch 35 is configured for preventing the mounting bracket 30 from being detached away the guide bar 20. The height (h1) between an upper end of the anti-theft member 34 and the bottom end of the piece 325*a* is smaller than the second height (h2) of a height of the third notch 310 when the ring latch 35 is in a locking state.

The seat 31 is configured for connecting with the screen and the guide bar 20. The seat 31 may be elongated shape, and extends along the up-and-down direction. The seat 31 has a plurality of recesses to connect with a rear surface of the screen and a third notch 310 to which the guide bar 20 is attached. The link portion 32 comprises a regulating portion 325 configured for adjusting an angle between the screen and the surface of the wall. A pathway 320 is defined in a middle of the regulating portion 325 and configured to act as a second channel for allowing the connecting member 21 to extend through the mounting bracket 30. The pathway 320 is air communicated with the third notch 310, and the pathway 320 is located near to the seat 31 relative to the third notch 310.

The blocking member 33 includes a locking plate 331 and a locking box 332, the locking plate 331 is slidable up and down relative to the locking box 332 to be locked in or unlocked from the locking box 332. A pull rope 36 is coupled to a lower end of the locking plate 331, the locking plate 331 moves downward and locked in the locking box 332 by pulling the pull rope 36 downward, and a spring (not shown) is installed in the locking box 332, and the locking plate 331 can be moving upward by the spring.

A rear side of the locking plate 331 and a rear side of the piece 325*a* are co-planar, and a third height (h3) is from an upper end of the locking plate 331 to a bottom end of the piece 325*a*, a height of the third notch 310 is a second height (h2), the locking box 332 is in a locked state when the locking plate 331 slides up by the spring, and the third height is smaller than the second height.

When the mounting bracket 30 is attached to the guide bar 20, the locking plate 331 and the anti-theft member 34 are abutted against the front side of the guide bar 20 for preventing the mounting bracket 30 from being detached away the guide bar 20.

When the mounting bracket 30 is needed to separate from the guide bar 20, the pull rope 36 is pulled downward, and the circular portion of the ring latch 35 is unlocked simultaneously, the locking plate 331 is thus moved downward, and the anti-theft member 34 is separated from a wing 321, thereby the mounting bracket 30 can be detached from the guide bar 20. Similarly, when the mounting bracket 30 is needed mounted on the guide bar 20, the pull rope 36 is pulled downward again, so that the locking plate 331 can be separated from a clamping portion (not shown) in the locking box 332 and moved up to the original position, so that the locking plate 331 engages with the guide bar 20, and then the anti-theft locking plate 34 and the wing 321 are locked together by the ring latch 35, the mounting bracket 30 is locked on the guide bar 20.

Figure 12:
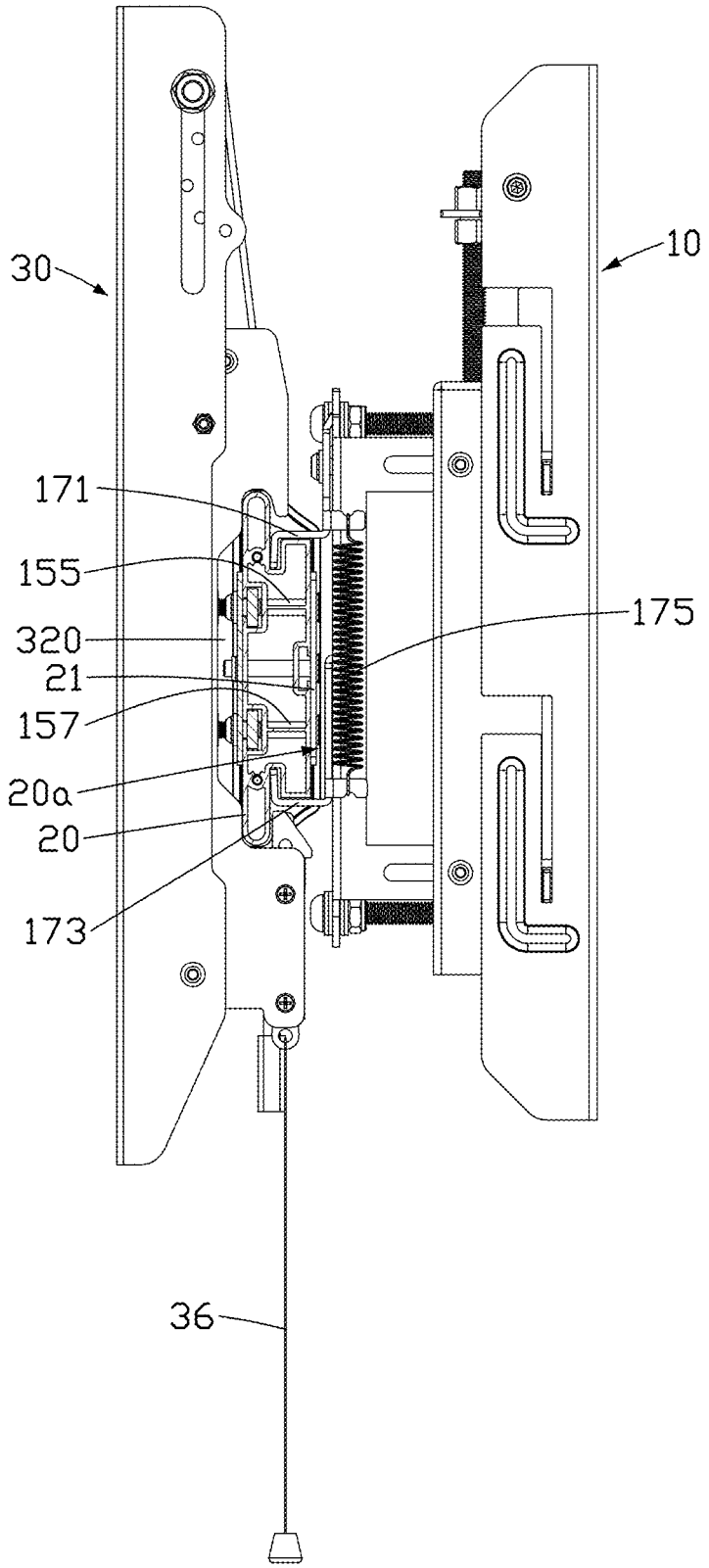
FIG. 12 illustrates a connect relation among the guide bar, the mounting bracket and the base of the mounting assembly shown in FIG. 3.

Refer to FIG. 12, The end of the guide bar 20 comprises a flat portion and an arc portion, so that an effective contact area between the guide bar 20 and the locking plate 331 is increased.

Second Embodiment

Referring to FIG. 13 to FIG. 19, reference numerals same as those in Embodiment 1 continue to be used for same elements in this embodiment. A difference between this embodiment and Embodiment 1 comprises the structure of the connecting portion 17 and the blocking member 33.

Figure 13:
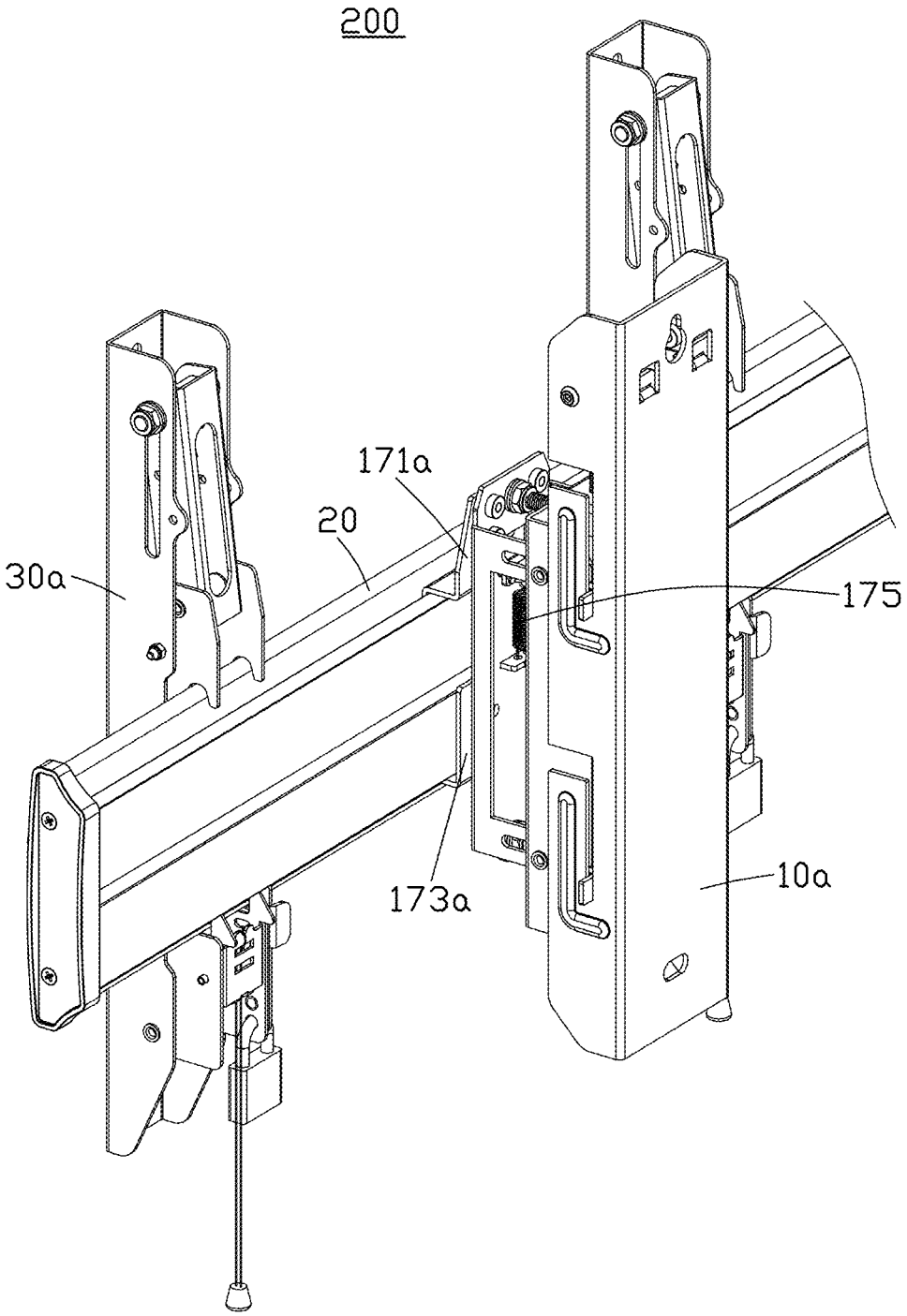
FIG. 13 is an enlarged view of a portion of a mounting assembly according to a second embodiment of the present disclosure.
Figure 14A:
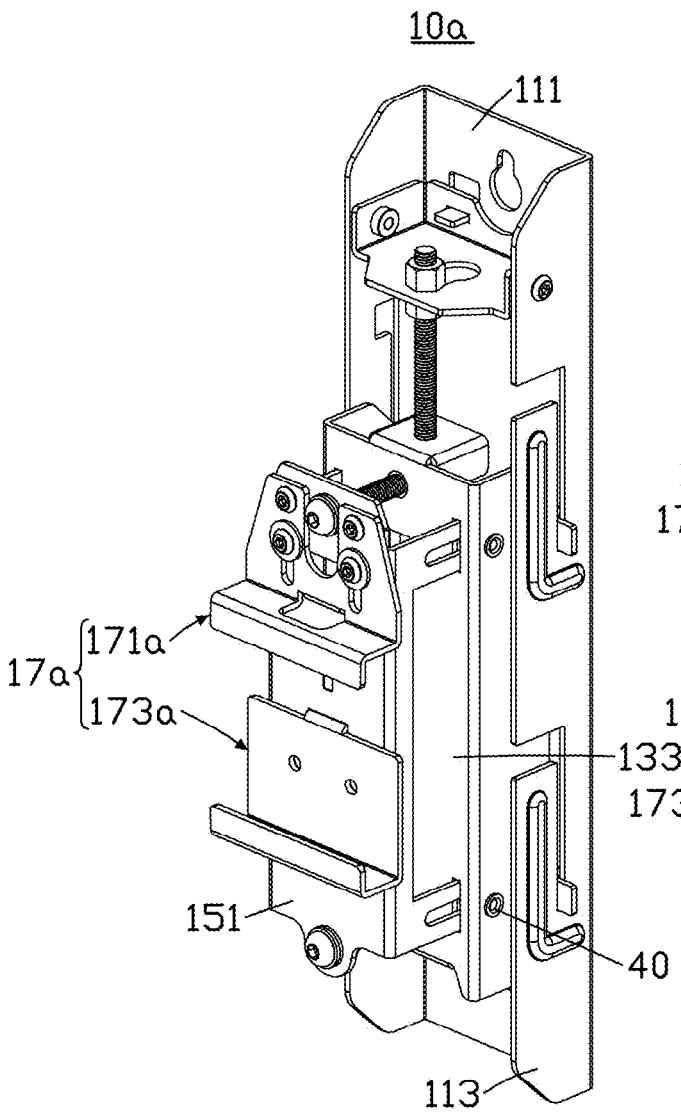
FIG. 14A and FIG. 14B are perspective views of a base of the mounting assembly shown in FIG. 13 viewing from opposite directions.
Figure 14B:
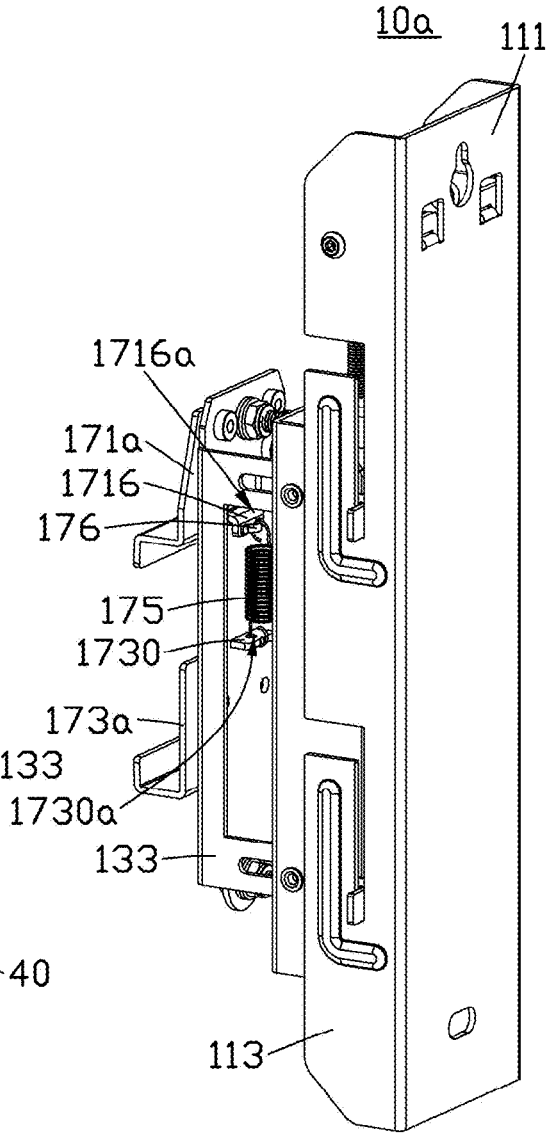

Refer to FIG. 13, FIG. 14A, and FIG. 14B, the upper end of the first connecting plate 171*a* is attached to the first wall 151 by two screws. A hook handle 176 inserted into a side of the first hole 1716*a* is protruded from the side of the bent tab 1716 for connecting to one end of the spring 175. A locking piece 1730 is extended from the backward of the second connecting plate 173*a* toward the main plate 11, and a second hole 1730*a* is defined in the middle portion of the locking piece 1730 and located corresponding to the first hole 1716*a* so as to connect to another end of the spring 175, thereby, only one spring 175 is required for this embodiment, opposite ends of the spring 175 are respectively hooked in the hooking handle 176 and the hole, and the spring 175 is not visible from the front direction or a lateral side direction of the base 10*a*. The spring 175 is thus hidden on the back of the first wall 151 to avoid the breakdown from the external force.

Figure 15A:
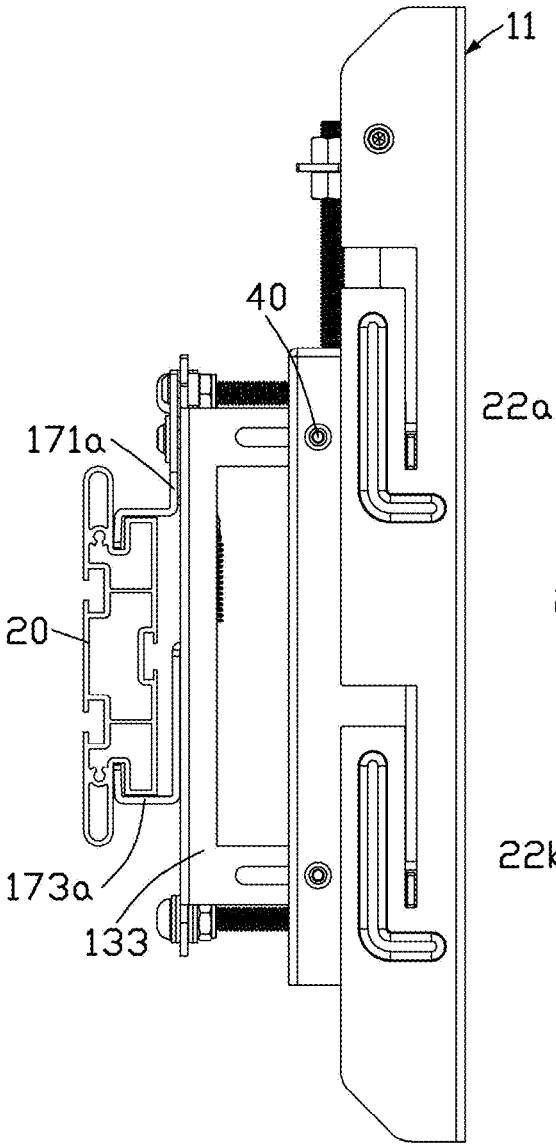
FIG. 15A illustrates a state of the guide bar being connected to the base of the mounting assembly shown in FIG. 13.
Figure 15B:
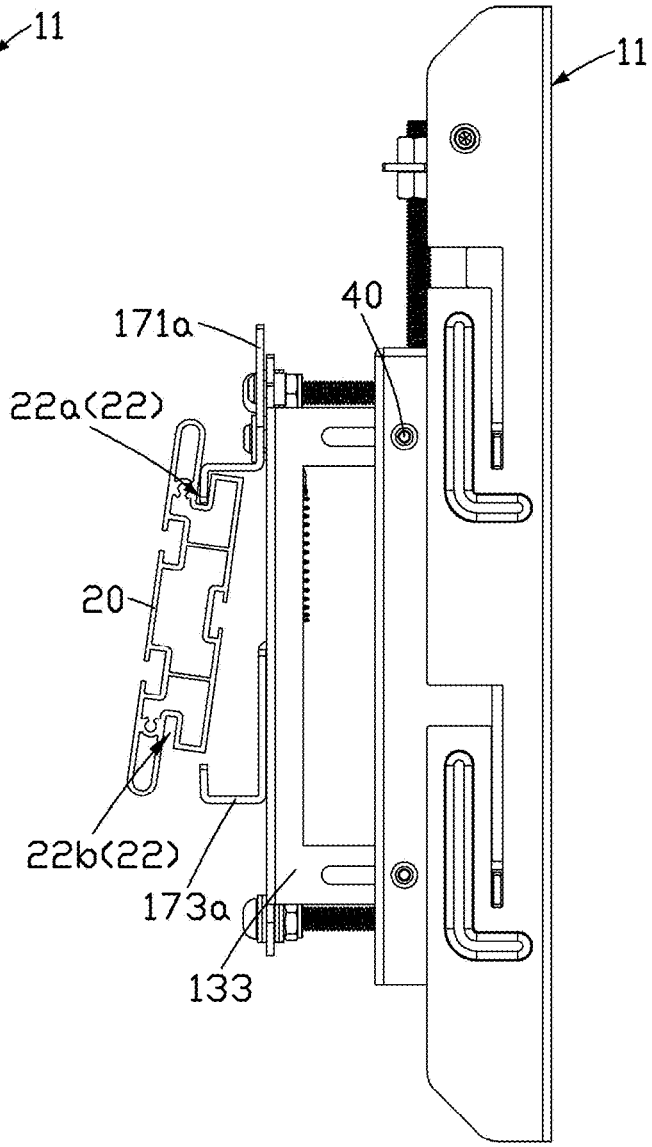
FIG. 15B illustrates a state of the guide bar to be released from the base according to the mounting assembly shown in FIG. 13.
Figure 16:
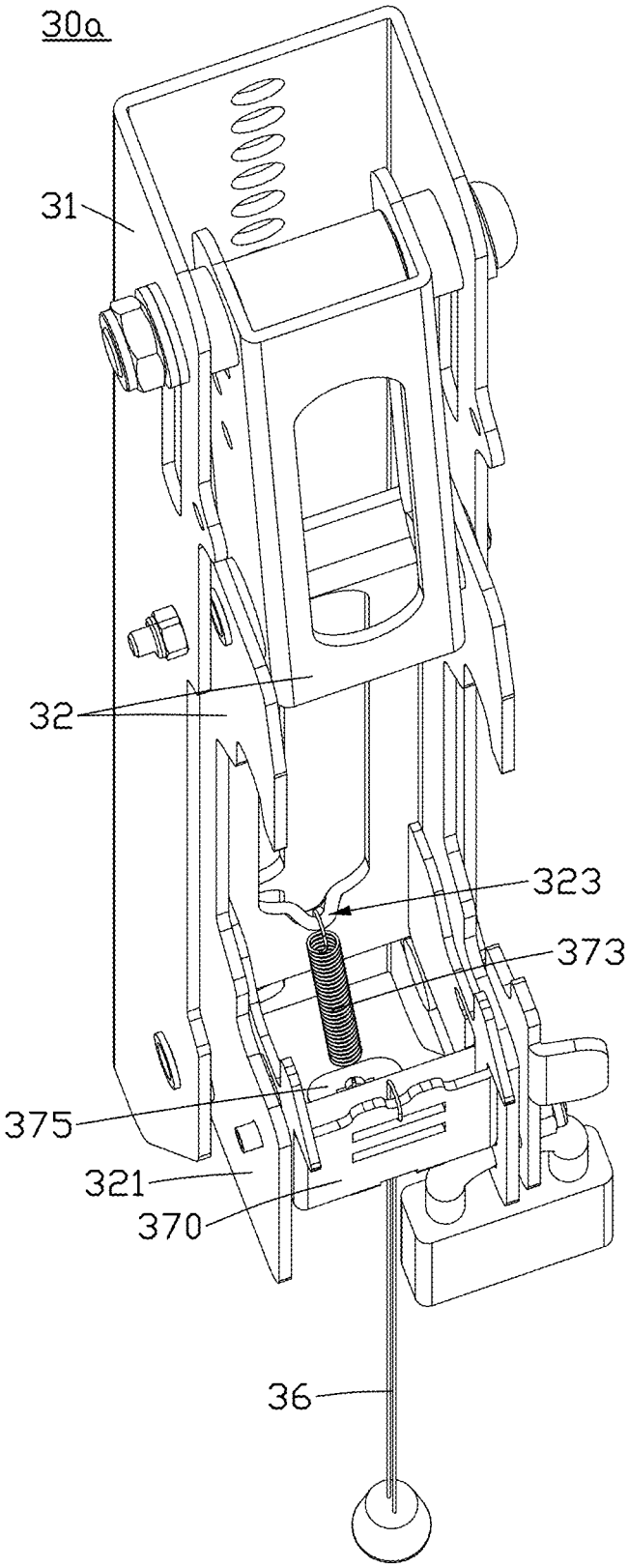
FIG. 16 is a perspective view of a mounting bracket of the mounting assembly shown in FIG. 13.
Figure 17:
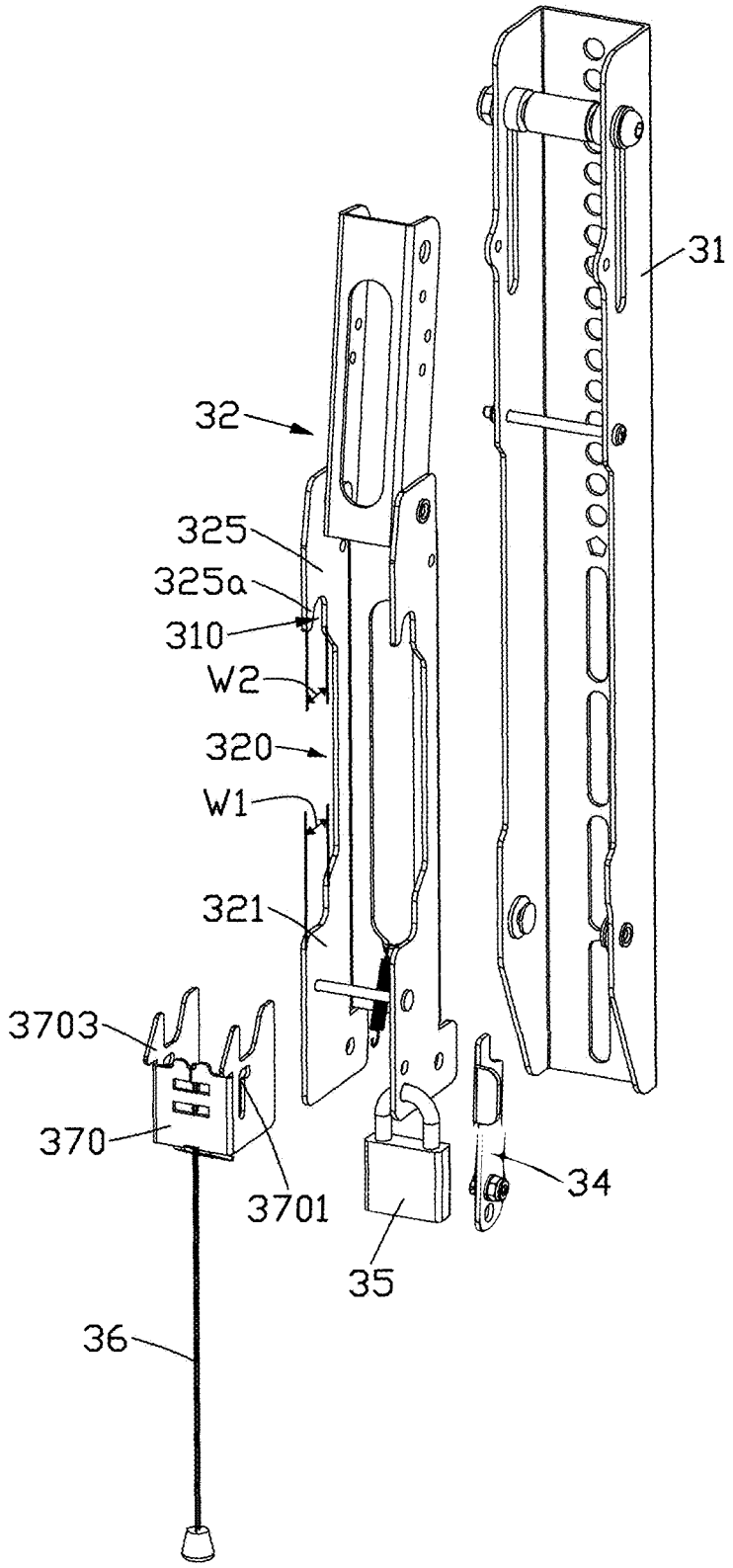
FIG. 17 is an exploded view of the mounting bracket of the mounting assembly shown in FIG. 16.

As shown in FIG. 15A and FIG. 15B, when it is needed to detach the guide bar 20 from the base 10*a*. At first, the two screws, comprising the second screw 155 and the third screw 157, are removed from the first connecting plate 171*a*, the fasteners 18 is loosened, and then the guide bar 20 is lifted up, so that the spring 175 between the first connecting plate 171*a* and the second connecting plate 173*a* is elongated. Finally, the lower portion of the guide bar 20 is moved outward to detach from the base 10*a*.

Refer to FIG. 16 to FIG. 18A, The regulating portion 325 comprises a piece 325*a* and a wing 321, the piece 325*a* configured for clamping an upper portion of the guide bar 20, and a wing 321 disposed below the piece 325*a* and against an underside of the guide bar 20, the wing 321 is arranged in parallel with an end of the guide bar 20. A width of the wing 321 (w1) is larger than a width of the piece 325*a* (w2), the piece 325*a* and the wing 321 cooperatively define the third notch 310 to receive the guide bar 20. The wing 321 comprises a pair of wings, the two opposite sides of the wing 321 are respectively provided with a blocking member 33.

Figure 18A:
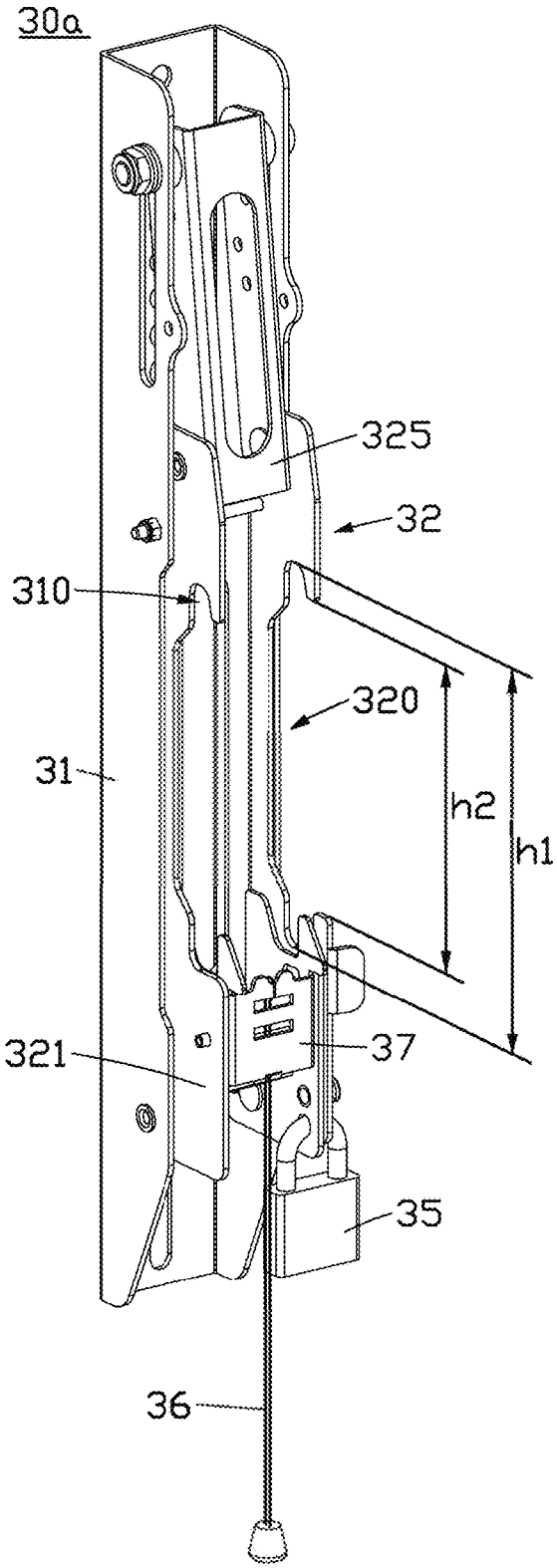
FIG. 18A is a perspective view of the mounting bracket of the mounting assembly shown in FIG. 13.
Figure 18B:
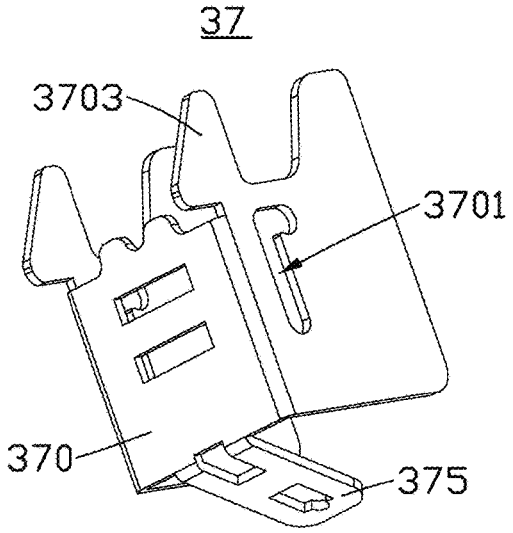
FIG. 18B is a perspective view of a blocking member of the mounting assembly shown in FIG. 13.

As shown in FIG. 18B, the blocking member 37 comprises a frame portion 370, an elastic member 373, and a hanging rod 375. A broach slot (not shown) is defined in an upper end of the frame portion 370 for hooking a side of the rope 36. The hanging rod 375 is extended toward the seat 31 and protruded from the bottom side of the frame portion 370 at an obtuse angle.

Two sliding slots 3701 are defined in the two opposite sides of the frame portion 370, each sliding slot 3701 is L-shaped, allowing two ends of a caulking member 3705 to penetrate and slide in each sliding slot 3701. The frame portion 370 is received in a space between the two wings 321 at the lower end of the link portion 32 by inserting the caulking members 3705 into the slide grooves 3701. A pair of hooks 3703 disposed at the two opposite sides of the frame portion 370 are configured to abut against the backward of the guide bar 20. The hook 3703 and the piece 325*a* are co-planar, and a first height (h1) is from an upper end of the hook 3703 to a bottom end of the piece 325*a*, a height of the third notch 310 (h2) is a second height, the first height (h1) is smaller than the second height (h2).

The elastic member 175 has two opposite ends, one of the two opposite ends is connected to an engaging portion 323 formed at the lower end of the link portion 32, and another is connected to the hanging rod 375.

Figure 19A:
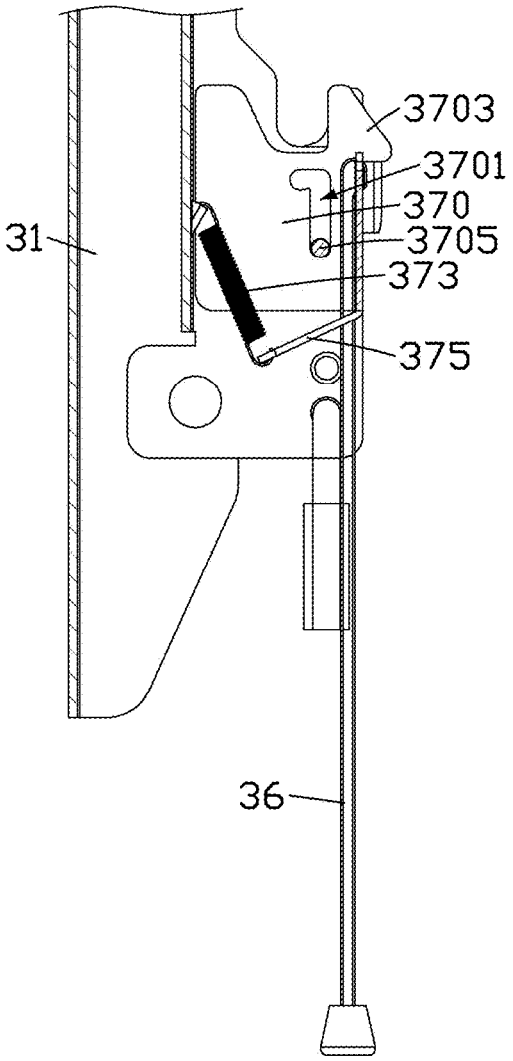
FIG. 19A illustrates the mounting bracket shown in FIG. 16, in an original position.
Figure 19B:
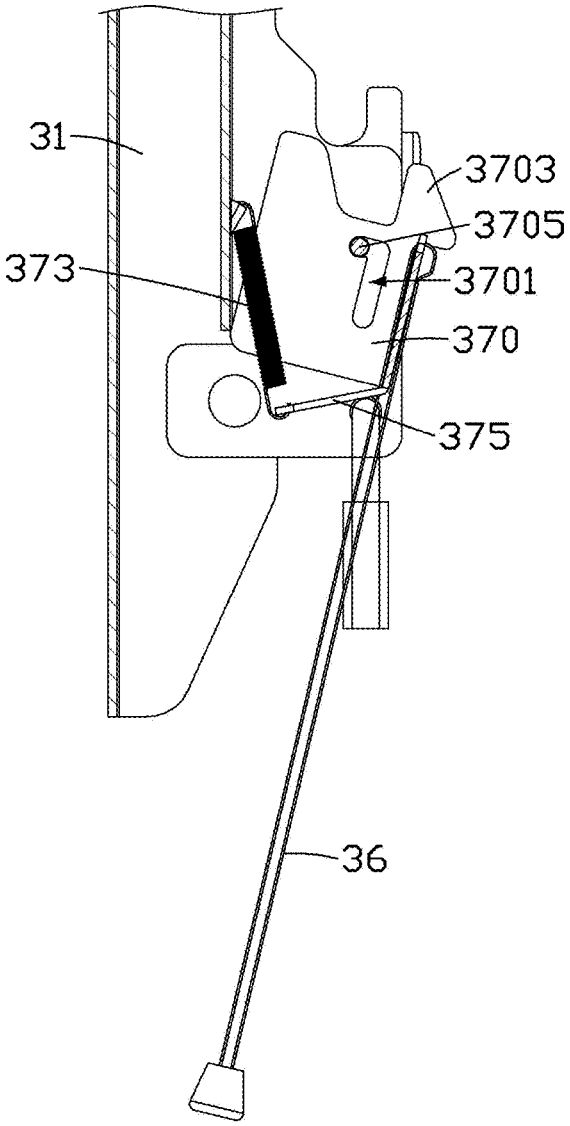
FIG. 19B illustrates the mounting bracket shown in FIG. 16, in a deviated position.

As shown in FIG. 19A, When the blocking member 33 is in a locked state, the blocking member 37 is disposed upright and perpendicular to the guide bar 20, and completely received in the space between the both wings 321, the pair of hooks 3703 hook the guide bar 20, and the caulking member 3705 is located at the lowest end of the sliding slots 3701. As shown in FIG. 19B, when the blocking member 37 is in an unlocked state, the blocking member 37 is inclined with the seat 31, the hooks 3703 at the upper end of the blocking member 37 protrudes outward from the space between the both wings 321, so that the mounting bracket 30*a* can be easily detached from the guide bar 20.

In this embodiment, the mounting assembly 100 can mount one or more monitors together on the wall, and the location of the screen can be adjusted at the up-and-down direction, the front-and-rear direction and a left-and-right direction.

The assembly of the base 10*a* to the guide bar 20 is simplified. The first connecting plate 171*a* and the second connecting plate 173*a* can automatically buckled into the first groove 22*a* in the back of the guide bar 20 through the elastic force of the elastic member 373, and the base 10*a* can slide on the guide bar 20 smoothly without being blocked by the first/second connecting member 21. Thereby, only a single person can conveniently attach the guide bar 20 to the base 10*a*, and when locking or unlocking between the mounting bracket 30*a* and the guide bar 20, just to pull the rope 36.

What is claimed is:

1. A mounting assembly configured for attaching at least one apparatus to a wall, the mounting assembly comprising:

at least one mounting bracket configured to be connected to the at least one apparatus;

a guide bar coupled with the at least one mounting bracket, the guide bar extending in an extending direction; and, at least one base coupled to the guide bar, the at least one base comprising a first base, the first base comprising:

a main plate configured to be attached to the wall;

a first connecting plate configured for engaging with an upper portion of the guide bar; and a second connecting plate disposed opposite to the first connecting plate at a first direction perpendicular to the extending direction of the guide bar, and the second connecting plate configured for engaging with a lower portion of the guide bar, wherein the first connecting plate and the second connecting plate are attached to the main plate and spaced apart in the first direction, the first connecting plate cooperates with the second connecting plate to define a receiving space, one of the first connecting plate and the second connecting plate is movable toward and away from another one of the first connecting plate and the second connecting plate; a distance between the first connecting plate and the second connecting plate is adjustable by moving the one of the first connecting plate and the second connecting plate relative to the other one of the first connecting plate and the second connecting plate; a portion of the guide bar is insertable into the receiving space in response to the one of the first connecting plate and the second connecting plate being moved away from the other one of the first connecting plate and the second connection plate, and the first and the second connecting plates cooperatively limit the portion of the guide bar in the receiving space.

2. The mounting assembly according to claim 1, wherein the first connecting plate and the second connecting plate are slidable along the extending direction of the guide bar, the guide bar comprises multiple sub-bars each extending along the extending direction and a first connecting member configured for connecting the multiple sub-bars, the first connecting member is attached to each of rear sides of the multiple sub-bars, the base defines a first channel located correspondingly to the first connecting member, the first connecting member is extendable through the first channel in response to the first connecting plate and the second connecting plate are slid along the extending direction of the guide bar and slidable between the multiple sub-bars before the main plate is fastened on the wall.

3. The mounting assembly according to claim 1, wherein the first connecting plate comprises a first plate and a blocking portion perpendicularly interconnected with a bottom of the first plate, the second connecting plate comprises a second plate and a second blocking portion perpendicularly interconnected with a bottom of the second plate, the first plate is movably attached to the main plate, the second plate fixedly is attached to the main plate, and the blocking portion and the second blocking portion are arranged opposite to each other and configured to be engaged with the guide bar.

4. The mounting assembly according to claim 3, wherein two locking tabs extend upwardly and rearward from a top of the first plate, two through-holes located corresponding to the locking tabs are defined in the front side of the main plate, the two locking tabs engage with the two through-holes, respectively.

5. The mounting assembly according to claim 4, wherein a bent tab is extended rearward from a lower edge of the first connecting plate and bents downwardly, a locking piece is formed on a top of the second plate, the first connecting plate is connected to the main plate through the bent tab, and the second connecting plate is connected to the main plate through the locking piece.

6. The mounting assembly according to claim 1, further comprising at least one spring configured for driving the one of the first connecting plate and the second connecting plate to move towards the other one of the first connecting plate and the second connecting plate, wherein the one of the first connecting plate and the second connecting plate is movable away from the other one of the first connecting plate and the second connection plate by applying an external force on the one of the first connecting plate and the second connecting plate;

in response to the one of the first connecting plate and the second connecting plate being moved away from the other one of the first connecting plate and the second connection plate, a length of the receiving space in the first direction is increased and the at least one spring is elastically deformed; and in response to the portion of the guide bar being inserted in the receiving space and the external force being removed from the one of the first connecting plate and the second connecting plate, the at least one spring elastically deflects and drives the one of the first connecting plate and the second connecting plate to move the other one of the first connecting plate and the second connecting plate.

7. The mounting assembly according to claim 5, further comprising a first hole defined in the bent tab; and a second hole defined in the locking piece, wherein the first hole and the second hole are located corresponding to each other;

the mounting assembly further comprising a spring attached to the first and the second holes, the spring connecting the first connecting plate and the second connecting plate, and elastically compressed by the first and the second connecting plates.

8. The mounting assembly according to claim 1, wherein the base is further configured to receive the guide bar into the receiving space by selecting from one of a first assembly way and a second assembly way, the guide bar is inserted into the receiving space along the extending direction in the first assembly way, the guide bar is inserted into the receiving space along a second direction in the second way, the second direction intersects with each of the extending direction and the first direction.

9. The mounting assembly according to claim 1, wherein the guide bar comprises a plurality of sub-bars and at least one second connecting member, each of the at least one second connecting member is configured for connecting two corresponding sub-bars of the plurality of sub-bars, each of the at least one second connecting member is attached to front surfaces of the two corresponding sub-bars, each of the at least one mounting bracket defines a second channel at a location corresponding to the at least one second connecting member, the at least one second connecting member is extendable through the second channel in response to the mounting bracket being slid on the guide bar.

10. The mounting assembly according to claim 1, wherein the first base further comprises a first adjustment portion adjustably attached to the main plate and movable in the first direction, a second adjustment portion adjustably coupled to the first adjustment portion and movable at a second direction, and a connecting portion coupled to the second adjustment portion, the connecting portion is configured for connecting with the guide bar, the first direction, the second direction and the extending direction are perpendicular to each other.

11. The mounting assembly according to claim 1, wherein each of the at least one mounting brackets comprises:

a piece configured for clamping an upper portion of the guide bar, and a wing disposed below the piece and against an underside of the guide bar, the wing is arranged in parallel with an end of the guide bar, a width of the wing is larger than a width of the piece, the piece and the wing cooperatively define a notch to receive the guide bar, and each of the at least two mounting brackets is slidable in the guide bar along the extending direction of the guide bar, wherein the wing comprises a pair of wings and blocking members on two opposite sides of the wing respectively, are configured to clamp to a bottom end of the guide bar, the blocking member and the piece are co-planar, and a first height is from an upper end of the blocking member to a bottom end of the piece, a height of the notch is a second height, the first height is smaller than the second height.

12. The mounting assembly according to claim 11, wherein each of the blocking member comprises a first blocking member installed in a side of one of the pair of wings, and the first blocking member comprises:

a locking plate configured to move closer to or further away from the piece, a locking box defining a first-hole to install the locking plate, and an upper portion of the locking plate protrudes out of the locking box, a rear side of the locking plate and a rear side of the piece are co-planar, the locking box is fixedly received in a side of the wing, and a rope coupled to a lower end of the locking plate, and is configured to pull the locking plate to be closer to or further away from the piece, the locking box is in a locked state in response to the locking plate is slid up by pulling the rope, and the first height is smaller than the second height, the locking box is in an unlocked state in response to the locking plate is slid down by pulling the rope, and the first height is larger than the second height.

13. The mounting assembly according to claim 12, wherein the blocking member further comprises a second blocking member installed in a side of another wing of the pair of wings, wherein the second blocking member comprises:

an anti-theft member detachably attached to the other wing; and a ring latch configured for locking the anti-theft member and the other wing, the height between an upper end of the anti-theft member and the bottom end of the piece is smaller than the second height when the ring latch is in a locking state.

14. The mounting assembly according to claim 11, wherein the mount bracket further comprises:

a seat configured for connecting with a screen of the at least one apparatus, and a link portion fixed to an inner side of the seat and configured to be attached to the guide bar, the pair of wings are located in a lower end of the link portion, the blocking member comprises a frame portion, an elastic member, a hanging rod and a rope, the frame portion is received in a space between the pair of wings, and a pair of hooks are disposed at the two opposite sides of the frame portion, the pair of hooks are configured to abut against the guide bar, a side of each of the pair of hooks near the notch and the piece are co-planar, and a height of an upper end of the hook to the bottom of the piece is smaller than the second height, the rope is fixedly attached to a side of the frame portion, and configured for pulling the pair of hooks to move further away from the pair of wings, the hanging rod extends and protrudes from a bottom side of the frame portion at an obtuse angle, the elastic member is configured for driving the frame portion to move closer to or further away from the of wings in response to the rope being pulled, the elastic member has two opposite ends, one end of the two opposite ends is connected to a lower end of the link portion, and another end is connected to the hanging rod.

15. The mounting assembly according to claim 1, wherein the lower portion of the guide bar is configured to rest on the second connecting plate and upwardly protrude out of the second connecting plate.

16. The mounting assembly according to claim 1, wherein the second connecting plate is fixedly attached to the main plate and is unmovable in the first direction.

17. The mounting assembly according to claim 1, wherein the first connecting plate and the second connecting plate are detachably attached to the main plate.

18. A mounting assembly configured for attaching at least one apparatus to a wall, the mounting assembly comprising:

at least one mounting bracket configured to be connected to the at least one apparatus;

a guide bar coupled with the at least one mounting bracket, the guide bar extending in an extending direction; and, at least one base coupled to the guide bar, the at least one base comprising a first base, the first base comprising:

a main plate configured to be attached to the wall;

a first connecting plate configured for engaging with the guide bar; and a second connecting plate disposed opposite to the first connecting plate at a first direction perpendicular to the extending direction of the guide bar, wherein the first connecting plate and the second connecting plate are attached to the main plate, the first connecting plate cooperates with the second connecting plate to define a receiving space, the first connecting plate is movable in the first direction, the base receives a portion of the guide bar into the receiving space in response to one of the first connecting plate and the second connecting plate being moved away from another one of the first connecting plate and the second connection plate, and the first and the second connecting plates cooperatively limit the portion of the guide bar in the receiving space, wherein the first connecting plate is spaced from the second connecting plate, the receiving space is defined by a front portion of the first connecting plate and a front portion of the second connecting plate, a first channel is defined by a rear portion of the first connecting plate and a rear portion of the second connecting plate, and a first connecting member is extendable through the first channel in response to the first connecting plate and the second connecting plate being slid along the extending direction of the guide bar, the first channel is located behind the receiving space, a width of the first channel is larger than a width of the first connecting member and is smaller than a width of the receiving space, and a height of the first channel is larger than a height of the first connecting member and is smaller than a height of the receiving space, such that the first connecting member can pass through the first channel in response to the first connecting plate and the second connecting plate being slid along the extending direction to a position of the guide bar where the first connecting member is located.

19. A mounting assembly configured for attaching at least one apparatus to a wall, the mounting assembly comprising:

at least one mounting bracket configured to be connected to the at least one apparatus;

a guide bar coupled with the at least one mounting bracket, the guide bar extending in an extending direction; and, at least one base coupled to the guide bar, the at least one base comprising a first base, the first base comprising:

a main plate configured to be attached to the wall;

a first connecting plate configured for engaging with the guide bar; and a second connecting plate disposed opposite to the first connecting plate at a first direction perpendicular to the extending direction of the guide bar, wherein the first connecting plate and the second connecting plate are attached to the main plate, the first connecting plate cooperates with the second connecting plate to define a receiving space, the first connecting plate is movable in the first direction, the base receives a portion of the guide bar into the receiving space in response to one of the first connecting plate and the second connecting plate being moved away from another one of the first connecting plate and the second connection plate, and the first and the second connecting plates cooperatively limit the portion of the guide bar in the receiving space, wherein the mounting assembly further comprising a pair of springs disposed at opposite sides of each of the first connecting plate and the second connecting plate and extending along the first direction, the pair of springs elastically deform to move the one of the first connecting plate and the second connecting plate towards the another one of the first connecting plate the second connecting plate.

20. The mounting assembly according to claim 19, further comprising:

two first protrusions protruding and extending from two sides of the first connecting plate, respectively; and two second protrusions protruding and extending from two sides of the second plate, respectively, wherein each side of the first connecting plate and the corresponding side of the second connecting plate are attached by one of the pair of springs.

* * * * *